US010196836B2

(12) United States Patent
Tracy, Jr. et al.

(10) Patent No.: US 10,196,836 B2
(45) Date of Patent: Feb. 5, 2019

(54) LOCKING SYSTEM

(71) Applicant: HNI Technologies Inc., Muscatine, IA (US)

(72) Inventors: Daniel Tracy, Jr., Muscatine, IA (US); Trent Busch, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 400 days.

(21) Appl. No.: 14/686,011

(22) Filed: Apr. 14, 2015

(65) Prior Publication Data

US 2015/0292247 A1 Oct. 15, 2015

Related U.S. Application Data

(60) Provisional application No. 61/979,350, filed on Apr. 14, 2014.

(51) Int. Cl.

| | |
|---|---|
| ***E05B 65/46*** | (2017.01) |
| ***E05B 65/462*** | (2017.01) |
| *E05C 3/04* | (2006.01) |

(52) U.S. Cl.

CPC ..... *E05B 65/46* (2013.01); *E05B 65/462* (2013.01); *E05C 3/042* (2013.01)

(58) Field of Classification Search

CPC ..... E05B 65/462; E05B 65/464; E05B 65/46; E05B 65/463; E05B 65/468; E05B 65/466; Y10T 70/5128; Y10T 292/1046; Y10T 70/5115; Y10T 292/0829; Y10T 292/0854; Y10T 292/0855; Y10T 292/0924

See application file for complete search history.

(56) References Cited

U.S. PATENT DOCUMENTS

| | | | | |
|---|---|---|---|---|
| 1,805,019 | A | 5/1931 | Smiley, Jr. | |
| 1,811,471 | A | 6/1931 | Larson et al. | |
| 1,836,354 | A | 12/1931 | Abrams | |
| 1,934,644 | A | 11/1933 | Rand | |
| 2,232,004 | A | 2/1941 | Hunter | |
| 2,423,863 | A | 7/1947 | Wales | |
| 2,686,704 | A | 8/1954 | Wolters | |
| 2,793,927 | A * | 5/1957 | Reitzel | E05B 65/462 292/341.15 |
| 3,598,462 | A * | 8/1971 | Kanitz | A47B 63/06 292/96 |
| 3,776,007 | A * | 12/1973 | Himsl | E05B 65/462 292/215 |
| 3,948,410 | A | 4/1976 | Anderson | |
| 4,026,004 | A | 5/1977 | Fields et al. | |
| 4,057,307 | A * | 11/1977 | Scheerhorn | E05B 65/468 312/219 |
| 4,381,842 | A | 5/1983 | Dezawa | |

(Continued)

*Primary Examiner* — Mark A Williams

(74) *Attorney, Agent, or Firm* — Faegre Baker Daniels LLP

(57) ABSTRACT

A locking system includes a first wire, a first block, a locking core, and a cam. The first wire includes at least one positioning structure and the first block is attached to the first wire at a first positioning structure of the at least one positioning structure to prevent movement of the first block on the first wire. The locking core rotates between a locked position and an unlocked position, and the cam is secured to the locking core to move the first block between a first position that corresponds to the locked position and a second position that corresponds to the unlocked position.

13 Claims, 20 Drawing Sheets

(56) References Cited

U.S. PATENT DOCUMENTS

| | | | | |
|---|---|---|---|---|
| 4,692,984 | A | | 9/1987 | McKernan et al. |
| 4,925,257 | A | * | 5/1990 | Frederiksen ..... E05B 65/463 312/221 |
| 5,231,862 | A | | 8/1993 | Ashley |
| 5,385,039 | A | * | 1/1995 | Feldpausch ..... E05B 65/462 312/219 |
| 5,595,076 | A | * | 1/1997 | Weinerman ..... E05B 5/00 292/34 |
| 5,632,166 | A | * | 5/1997 | Wiersma ..... E05C 9/045 292/337 |
| 6,007,170 | A | | 12/1999 | Liebertz et al. |
| 7,021,110 | B2 | | 4/2006 | Rosskamp |
| 8,128,183 | B2 | | 3/2012 | Shen et al. |
| 8,317,274 | B2 | | 11/2012 | Hsiao |
| 2011/0181160 | A1 | | 7/2011 | Peng et al. |
| 2011/0273069 | A1 | | 11/2011 | Chen et al. |

* cited by examiner

LOCKING SYSTEM

CROSS-REFERENCE TO RELATED APPLICATION

This application claims priority to Provisional Application No. 61/979,350, filed Apr. 14, 2014, which is herein incorporated by reference in its entirety.

BACKGROUND

Typically, locking systems are used to lock or secure a structure from intrusion. Some locking systems lock or secure the doors and windows of buildings. Some locking systems lock or secure the drawers or doors of cabinets. Manufacturers continue developing locking systems that have reduced costs and added features.

SUMMARY

Some embodiments described in this disclosure relate to a locking system that includes a wire, a block, a locking core, and a cam. The wire includes at least one positioning structure and the block is attached to the wire at a positioning structure on the wire to prevent movement of the block on the wire. The locking core rotates between a locked position and an unlocked position, and the cam is secured to the locking core to move the block between a first position that corresponds to the locked position and a second position that corresponds to the unlocked position. In some embodiments, the cam includes a notch that engages the block to move the block between the first position and the second position. In some embodiments, the locking system includes a lock stop attached to a cabinet to align the block with the cam. In some embodiments, the block in the first position interferes with the travel of a drawer slide of a drawer and the block in the second position allows the drawer to be opened and closed.

Some embodiments described in this disclosure relate to a cabinet locking system mounted in a cabinet. The cabinet locking system includes a locking core, a lock actuator, and a first block member. The locking core is secured to the cabinet and rotates between a locked position and an unlocked position, and the lock actuator is secured to the locking core to rotate between the locked position and the unlocked position. The first block member is situated in the cabinet and moved by the lock actuator. The first block member moves to interfere with a first drawer slide of a first drawer in the cabinet in the locked position and the first block member moves away from the first drawer slide in the unlocked position. In some embodiments, the cabinet locking system includes a first lock member that includes a first positioning structure attached to the first block member. In some embodiments, the cabinet locking system includes a first lock member that includes a first positioning structure attached to the first block member and a second positioning structure attached to a second block member that moves to interfere with a second drawer slide of a second drawer in the cabinet in the locked position and that moves away from the second drawer slide in the unlocked position. In some embodiments, the lock actuator includes a cam that has a notch that engages the first block member to positively move the first block member as the locking core rotates between the locked position and the unlocked position. In some embodiments, the cabinet locking system includes a lock stop attached to the cabinet to align the first block member with the lock actuator.

Some embodiments described in this disclosure relate to a locking system that includes a lock member, a block member, a locking core, and a lock actuator. The lock member includes at least one positioning structure, and the block member is attached to the lock member at a positioning structure of the lock member. The locking core rotates between a locked position and an unlocked position, and the lock actuator is secured to the locking core to move the block member between a first position that corresponds to the locked position and a second position that corresponds to the unlocked position.

Some embodiments described in this disclosure relate to a method of making a locking system. The method includes the steps of forming a first lock member to include at least one positioning structure, forming a block member, attaching the block member to the first lock member at a positioning structure of the at least one positioning structure, forming a lock actuator, securing the lock actuator to a locking core that rotates between a locked position and an unlocked position, aligning the lock actuator with the block member, and securing the locking core to a structure such that the lock actuator moves the block member between a first position that corresponds to the locked position and a second position that corresponds to the unlocked position. In some embodiments, forming the lock actuator includes forming a notch in the lock actuator, and aligning the lock actuator with the block member includes aligning the notch in the lock actuator with the block member to move the block member between the first position and the second position. In some embodiments, forming the first lock member comprises forming a first loop in the first lock member and the method includes the step of attaching a rod to the first loop and to a second loop in a second lock member to move the second lock member as the lock actuator moves the first lock member. In some embodiments, the method includes the step of attaching a lock stop to the structure to align the block member with the lock actuator.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
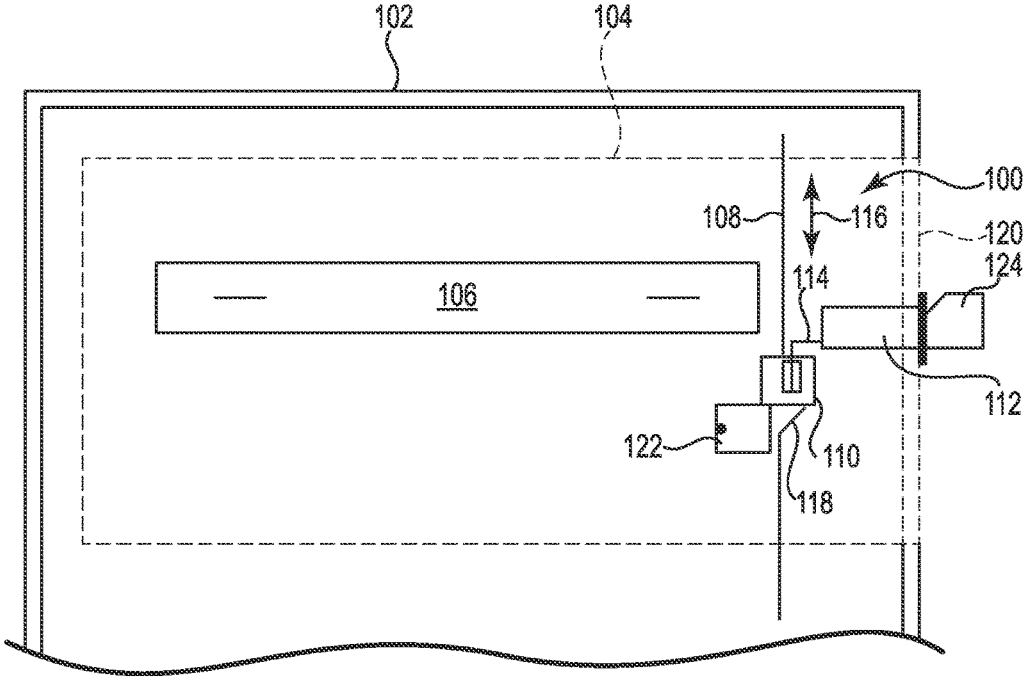
FIG. 1 is a diagram illustrating a locking system in an unlocked position, according to some embodiments.
Figure 2:
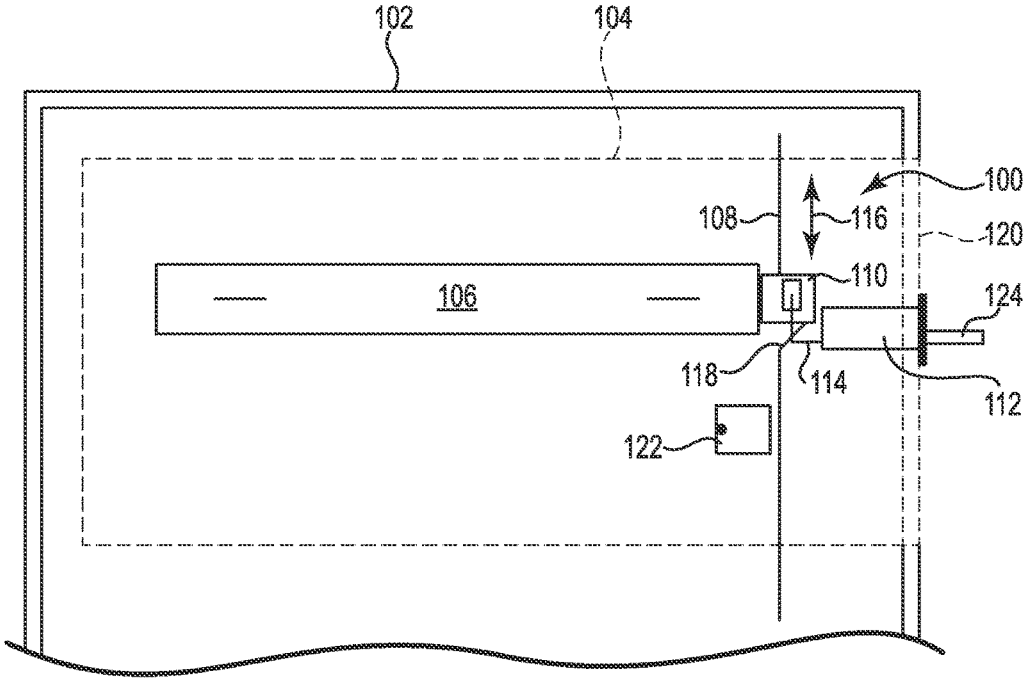
FIG. 2 is a diagram illustrating the locking system in a locked position, according to some embodiments.

FIGS. 1 and 2 are schematic diagrams illustrating a locking system 100 in a cabinet 102, according to some embodiments described in the disclosure. The locking system 100 is situated in the cabinet 102 and configured to lock the cabinet 102 to prevent one or more drawers, such as drawer 104, from opening and to unlock the cabinet 102 to allow the one or more drawers to be opened. FIG. 1 is a diagram illustrating the locking system 100 in an unlocked position, according to some embodiments. FIG. 2 is a diagram illustrating the locking system 100 in a locked position, according to some embodiments.

The cabinet 102 includes the drawer 104 and a drawer slide 106 connected to the drawer 104. The drawer 104 uses the drawer slide 106 for opening and closing the drawer 104. In some embodiments, the locking system 100 blocks or interferes with the drawer slide 106 to prevent the drawer 104 from opening. In some embodiments, the drawer 104 includes an attached locking structure (not shown) that the locking system 100 blocks or interferes with to prevent the drawer 104 from opening.

The locking system 100 includes a lock member 108, a block member 110, a locking core 112, and a lock actuator 114. The lock member 108 is attached to the cabinet 102, such that the lock member 108 can slide up and down in the cabinet 102, as indicated by arrow 116. The lock member 108 includes one or more positioning structures, such as positioning structure 118, along the length of the lock member 108. In some embodiments, the lock member 108 includes a wire lock member. In some embodiments, the lock member 108 includes a rigid wire that is bent to provide the positioning structures.

Block members, such as block member 110, can be attached to the lock member 108 at each of the positioning structures. The block members attached to the lock member 108, slide up and down in the cabinet 102 with the lock member 108, as the lock member 108 slides up and down in the cabinet 102. The block member 110 is attached to the lock member 108 at the positioning structure 118 such that the block member 110 and the lock member 108 slide up and down together in the cabinet 102. In some embodiments, the block member 110 is attached to the lock member 108 such that the block member 110 is prevented from moving on the lock member 108. In some embodiments, the block member 110 is snap fit onto the lock member 108. In some embodiments, the block member 110 is snap fit onto a wire lock member. In some embodiments, the block member 110 is a plastic piece that is snap fit onto a wire lock member. In some embodiments, the block member 110 is attached to the lock member 108 using a fastener, such as a screw.

The locking core 112 is a locking mechanism or lock that rotates between an unlocked position, shown in FIG. 1, and a locked position, shown in FIG. 2. The lock actuator 114 is secured to the locking core 112 and rotates with the locking core 112 between the locked position and the unlocked position. The locking core 112 is secured to the cabinet 102 and the lock actuator 114 is aligned with the block member 110. In some embodiments, the locking core 112 is secured to the front 120 of the drawer 104. In some embodiments, the lock actuator 114 is keyed to the locking core 112 to rotate with the locking core 112. In some embodiments, the lock actuator 114 includes a cam member. In some embodiments, the lock actuator 114 includes a rigid cam member. In some embodiments, the lock actuator 114 is made of a material, such as metal or plastic.

Optionally, the locking system 100 includes a lock stop member 122 that is attached to the cabinet 102. In the unlocked position, shown in FIG. 1, the lock stop member 122 abuts the block member 110 and aligns the block member 110 with the lock actuator 114.

In operation, a key 124 is inserted in the locking core 112 and the locking core 112 is rotated between the unlocked position and the locked position by turning the key 124. This rotates the locking core 112 and the lock actuator 114. The lock actuator 114 engages the block member 110 to slide the block member 110 and the lock member 108 up and down in the cabinet 102. In some embodiments, the lock member 108 and the attached block member 110 slide between ½ and 4 inches up and down in the cabinet 102.

In the unlocked position, shown in FIG. 1, the locking core 112 has been turned to the unlocked position, where the lock actuator 114 engages the block member 110 to positively move the block member 110 down in the cabinet 102. This moves the block member 110 from in front of the drawer slide 106 and unlocks the drawer 104 to allow the drawer 104 to be opened.

In the locked position, shown in FIG. 2, the locking core 112 has been turned to the locked position and the lock actuator 114 engages the block member 110 to positively move the block member 110 up in the cabinet 102. This moves the block member 110 in front of the drawer slide 106 and locks the drawer 104 to prevent the drawer 104 from being opened.

If other block members are attached to the lock member 108, each of the attached block members moves with the lock member 108 to unlock and lock a different drawer or door similar to the operation of block member 110.

FIGS. 3-10 are diagrams illustrating the locking core 112 and the lock actuator 114, according to some embodiments described in the disclosure. The lock actuator 114 is secured to the locking core 112 to rotate with the locking core 112 as the key 124 is turned in the locking core 112.

Figure 3:
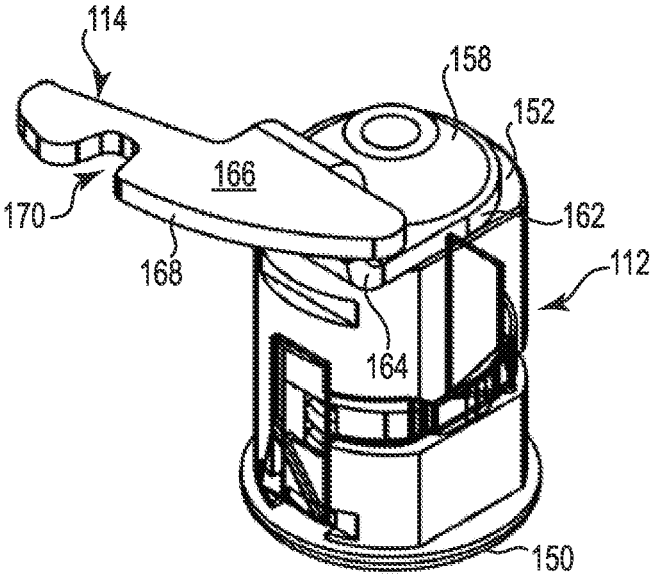
FIG. 3 is a diagram illustrating a rear perspective view of a lock actuator attached to a locking core, according to some embodiments.
Figure 4:
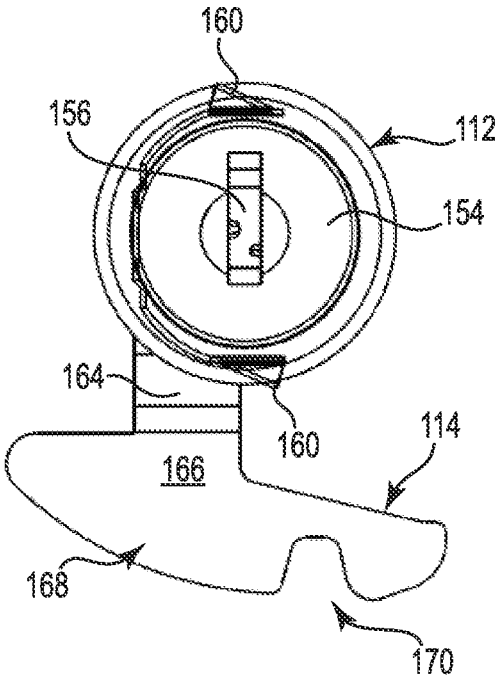
FIG. 4 is a diagram illustrating a front view of the lock actuator attached to the locking core, according to some embodiments.
Figure 5:
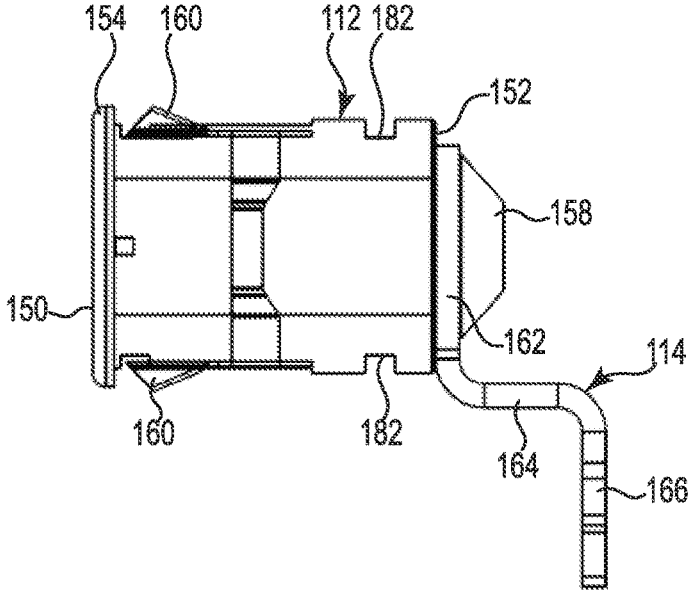
FIG. 5 is a diagram illustrating a side view of the lock actuator attached to the locking core, according to some embodiments.

FIGS. 3-5 are diagrams illustrating the lock actuator 114 attached to the locking core 112, according to some embodiments described in the disclosure. FIG. 3 is a diagram illustrating a rear perspective view of the lock actuator 114 attached to the locking core 112, according to some embodiments. FIG. 4 is a diagram illustrating a front view of the lock actuator 114 attached to the locking core 112, according to some embodiments. FIG. 5 is a diagram illustrating a side view of the lock actuator 114 attached to the locking core 112, according to some embodiments.

The locking core 112 is cylindrically shaped and has a front end 150 and a back end 152. The front end 150 includes a front face 154 with a key hole 156 formed in the front face 154. The key 124 is inserted into the key hole 156 to rotate the locking core 112. The locking core 112 is mounted on a structure, such as the cabinet 102, with the front face 154 and the key hole 156 visible and accessible to the user. The lock actuator 114 is secured to the back end 152 of the locking core 112 with a fastener 158, such as a screw or a flanged member. In some embodiments, the locking core 112 includes mounting tabs 160 for, optionally, mounting the locking core 112 to a structure, such as the cabinet 102 via the mounting tabs 160.

The lock actuator 114 includes an attachment portion 162, an extension portion 164, and a cam portion 166. The attachment portion 162 is attached to the locking core 112 via the fastener 158. The extension portion 164 connects the attachment portion 162 to the cam portion 166 and extends the cam portion 166 away from the locking core 112. The cam portion 166 is curved to form a cam shaped side 168. The cam portion 166 includes a notch 170 in the cam shaped side 168. The cam portion 166, including the notch 170, engages the block member, such as the block member 110, to lock and unlock a structure, such as the cabinet 102.

Figure 6:
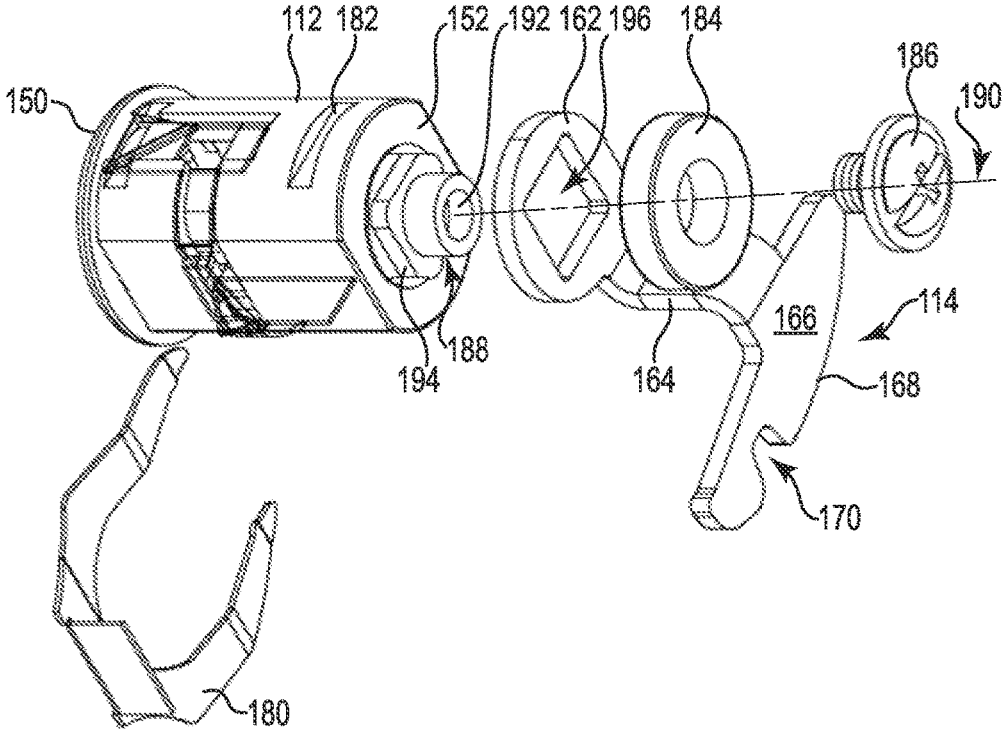
FIG. 6 is a diagram illustrating an exploded view of components that attach the locking core to the lock actuator and components that attach the locking core to a structure, according to some embodiments.

FIG. 6 is a diagram illustrating an exploded view of components that attach the locking core 112 to the lock actuator 114 and components that attach the locking core 112 to a structure, according to some embodiments described in the disclosure. The locking core 112 is, optionally, attached to a structure, such as the cabinet 102, by a flexing attachment member 180 that fits into slots 182 of the locking core 112. The slots 182 are located toward the back end 152 of the locking core 112 and the attachment member 180 is slid into the slots 182 and against the side of the structure to flex and hold the locking member 112 in place on the structure. The lock actuator 114 is attached to the locking core 112 by a washer 184 and a screw 186, as described below with reference to FIGS. 6-10.

Figure 7:
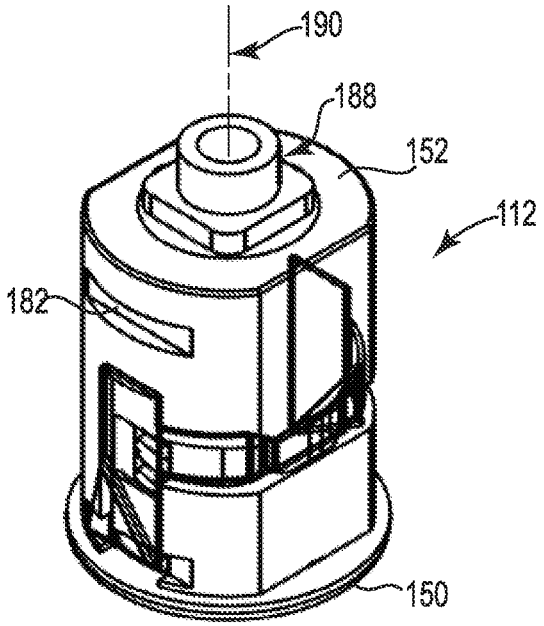
FIG. 7 is a diagram illustrating a rear perspective view of the locking core, according to some embodiments.
Figure 8:
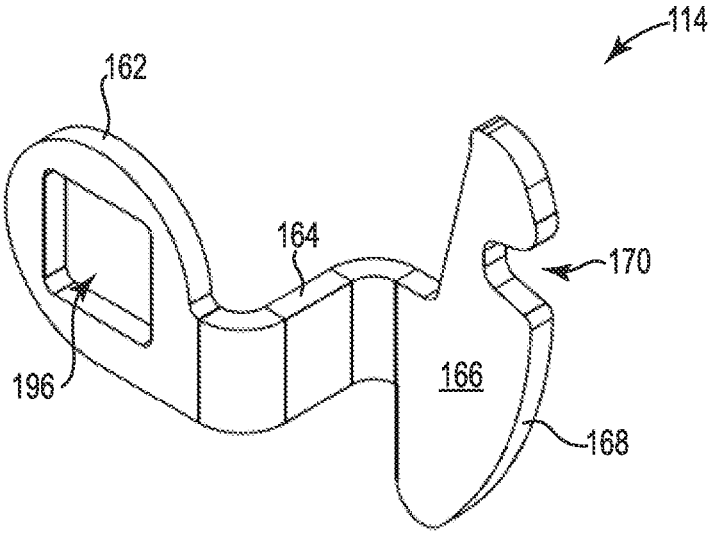
FIG. 8 is a diagram illustrating a front perspective view of the lock actuator, according to some embodiments.
Figure 9:
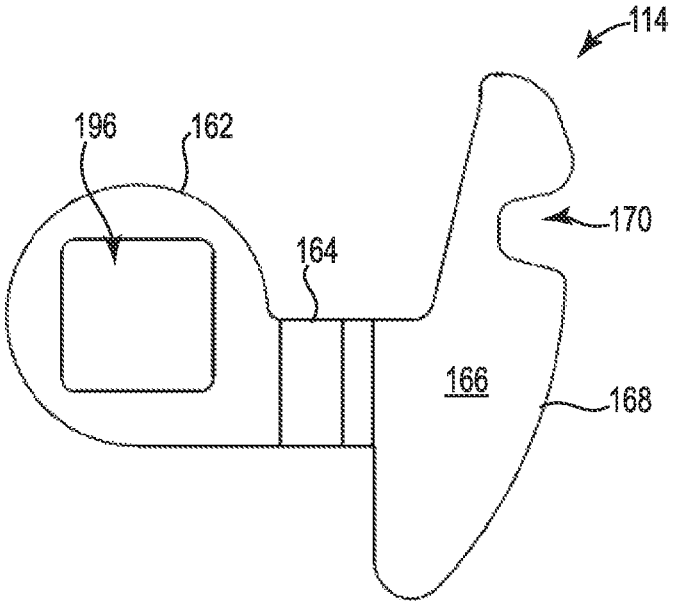
FIG. 9 is a diagram illustrating a front view of the lock actuator, according to some embodiments.
Figure 10:
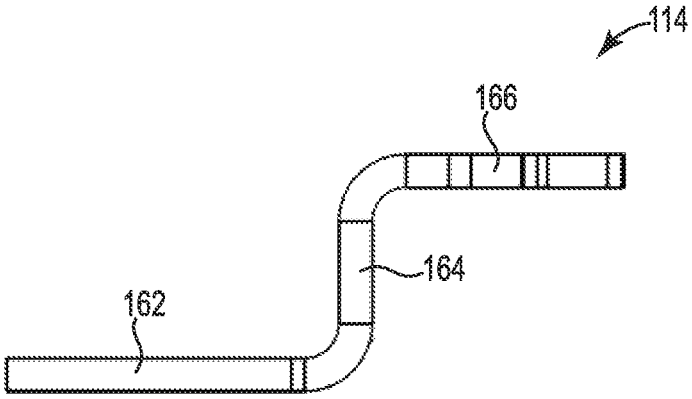
FIG. 10 is a diagram illustrating a side view of the lock actuator, according to some embodiments.

FIGS. 7-10 are diagrams illustrating the locking core 112 and the lock actuator 114, according to some embodiments described in the disclosure. FIG. 7 is a diagram illustrating a rear perspective view of the locking core 112, according to some embodiments. FIG. 8 is a diagram illustrating a front perspective view of the lock actuator 114, according to some embodiments. FIG. 9 is a diagram illustrating a front view of the lock actuator 114, according to some embodiments, and FIG. 10 is a diagram illustrating a side view of the lock actuator 114, according to some embodiments.

With reference to FIGS. 6 and 7, the locking core 112 includes a central shaft 188 that rotates on a central axis 190 as the key 124 is turned in the locking core 112. The central shaft 188 includes a threaded aperture 192 and a keying element 194 that turns with the central shaft 188.

With reference to FIGS. 6 and 8-10, the lock actuator 114 includes a keyed aperture 196 in the attachment portion 162 of the lock actuator 114. The keyed aperture 196 corresponds to the keying element 194 of the locking core 112. Also, the lock actuator 114 includes the extension portion 164 that connects the attachment portion 162 to the cam portion 166, and the cam portion 166 includes the cam shaped side 168 and the notch 170 in the cam shaped side 168. The extension portion 164 is perpendicular to the attachment portion 162 and perpendicular to the cam portion 166, such that the cam portion 166 is parallel to the attachment portion 162 and rotates in a plane that is perpendicular to the central axis 190 of the locking core 112.

To attach the lock actuator 114 to the locking core 112, the keyed aperture 196 is fit onto the keying element 194 and the washer 184 is aligned with the threaded aperture 192. Next, the screw 186 is tightened into the threaded aperture 192 against the washer 184 and the attachment portion 162. In operation, as the key 124 is turned in the locking core 112, the central shaft 188 including the keying element 194 turns, which turns the keyed lock actuator 114. This rotates the cam portion 166 of the lock actuator 114 in the plane perpendicular to the central axis 190 of the locking core 112 such that the cam portion 166 including the notch 170 engages a block member, such as the block member 110.

FIGS. 11-15 are diagrams illustrating block members 200 and 202 attached to a lock member 204, according to some embodiments described in the disclosure. In some embodiments, the lock member 204 and the attached block members 200 and 202 are used in the locking system 100 and cabinet 102 of FIGS. 1 and 2. In some embodiments, at least one of the block members 200 and 202 is similar to block member 110, shown in FIGS. 1 and 2. In some embodiments, the lock member 204 is similar to lock member 108, shown in FIGS. 1 and 2.

Figure 11:
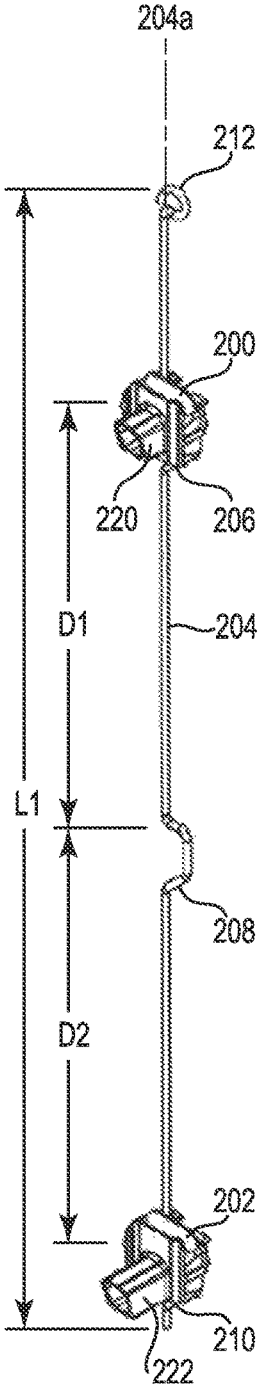
FIG. 11 is a diagram illustrating a front perspective view of block members attached to a lock member, according to some embodiments.
Figure 12:
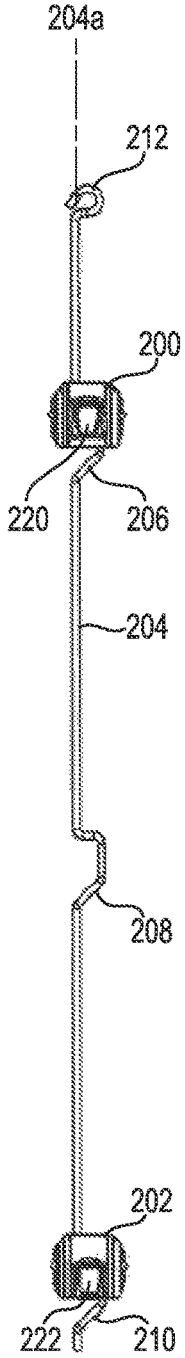
FIG. 12 is a diagram illustrating a side view, in relation to the cabinet of FIGS. 1 and 2, of the block members attached to the lock member, according to some embodiments.
Figure 13:
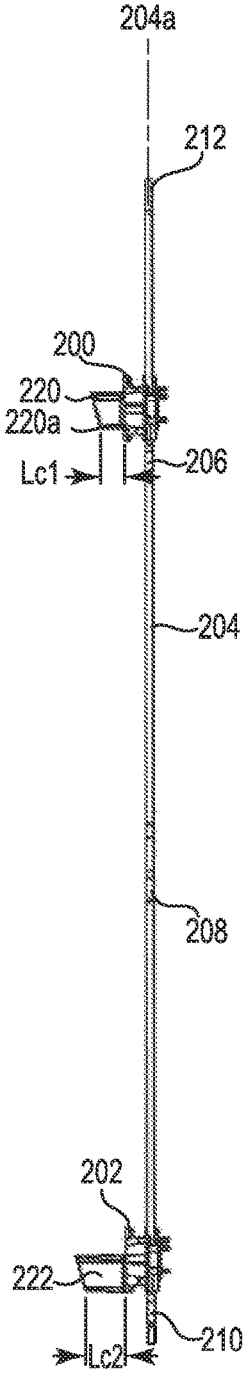
FIG. 13 is a diagram illustrating a front view, in relation to the cabinet of FIGS. 1 and 2, of the block members attached to the lock member, according to some embodiments.
Figure 14:
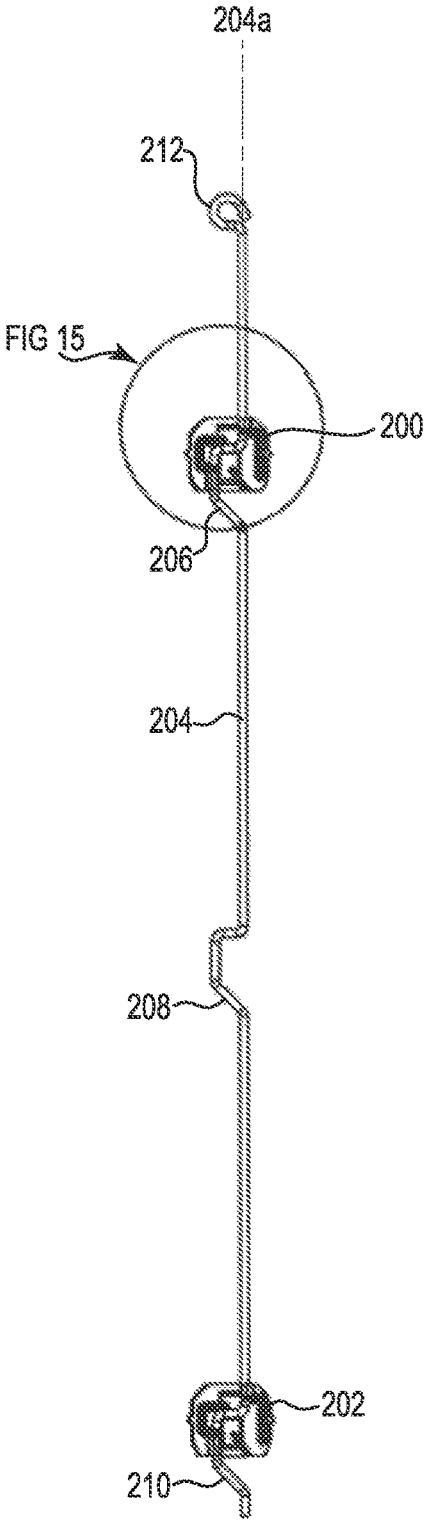
FIG. 14 is a diagram illustrating a rear perspective view of the block members attached to the lock member, according to some embodiments.
Figure 15:
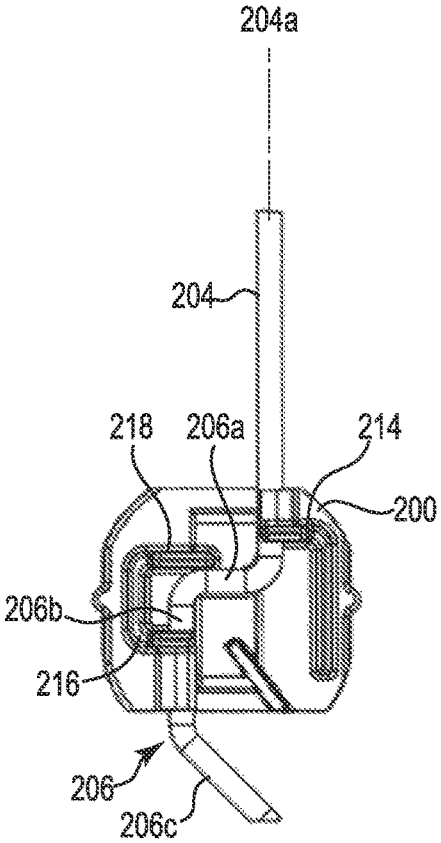
FIG. 15 is an enlarged view of the block member attached to the lock member, according to some embodiments.

FIG. 11 is a diagram illustrating a front perspective view of the block members 200 and 202 attached to the lock member 204, according to some embodiments. FIG. 12 is a diagram illustrating a side view, in relation to the cabinet 102 of FIGS. 1 and 2, of the block members 200 and 202 attached to the lock member 204, according to some embodiments. FIG. 13 is a diagram illustrating a front view, in relation to the cabinet 102 of FIGS. 1 and 2, of the block members 200 and 202 attached to the lock member 204, according to some embodiments. FIG. 14 is a diagram illustrating a rear perspective view of the block members 200 and 202 attached to the lock member 204, according to some embodiments. FIG. 15 is an enlarged view of the block member 200 attached to the lock member 204.

The lock member 204 is attached to a structure, such as the cabinet 102, to slide up and down in the structure. The lock member 204 includes three positioning structures 206, 208, and 210 situated along the length L1 of the lock member 204. The lock member 204 is a wire that is bent to provide the positioning structures 206, 208, and 210. In some embodiments, the positioning structures 206, 208, and 210 are evenly spaced apart along the length L1 of the lock member 204, such that distance D1 equals distance D2. In some embodiments, the positioning structures 206, 208, and 210 are unevenly spaced apart along the length L1 of the lock member 204, such that distance D1 does not equal distance D2.

The lock member 204 further includes a loop structure 212 at the top of the lock member 204 and has a longitudinal axis 204*a*. The loop structure 212 can be used to transfer movement of the lock member 204 to another lock member or another suitable member. In some embodiments, the loop structure 212 is at the bottom of the lock member 204.

As shown in FIG. 15, the positioning structure 206 includes a horizontal portion 206*a* that is perpendicular to the longitudinal axis 204*a* of the lock member 204, a vertical portion 206*b* that is parallel to the longitudinal axis 204*a* of the lock member 204, and a transverse portion 206*c* that is angled with respect to the longitudinal axis 204*a* of the lock member 204. The horizontal portion 206*a* connects the lock member 204 along its longitudinal axis 204*a* to the vertical portion 206*b*. The vertical portion 206*b* connects the horizontal portion 206*a* to the transvers portion 206*c*, and the transvers portion 206*c* connects the vertical portion 206*b* to the lock member 204 along its longitudinal axis 204*a*. In some embodiments, each of the positioning structures 208 and 210 is similar to the positioning structure 206.

Block members, such as block members 200 and 202, can be attached to the lock member 204 at each of the positioning structures 206, 208, and 210. The block member 200 is attached to the lock member 204 at the positioning structure 206 and the block member 202 is attached to the lock member 204 at the positioning structure 210. The attached block members 200 and 202 slide up and down with the lock member 204 to lock and unlock drawers or doors.

As shown in FIG. 15, the block member 200 is attached to the lock member 204 at the positioning structure 206. The block member 200 is snap fit onto the lock member 204 at the positioning structure 206 to prevent movement of the block member 200 on the lock member 204, such that the block member 200 moves up and down with the lock member 204. The block member 200 includes a first slot or canal that has a first overhanging or protruding structure at 214 and a second slot or canal that has a second overhanging or protruding structure at 216. The block member 200 further includes a horizontal block portion 218. In some embodiments, each of the block members, such as block member 202, is similar to block member 200.

The lock member 204, along its longitudinal axis 204*a* and above the horizontal portion 206*a*, is snap fit into the first slot at 214 and the vertical portion 206*b* is snap fit into the second slot at 216. The first and second overhanging or protruding structures at 214 and 216 extend over the lock member 204 and the positioning structure 206, respectively, and snap fit the lock member 204 into the block member 200. Also, the horizontal block portion 218 touches the horizontal portion 206*a* to prevent downward vertical movement of the block member 200 on the lock member 204. In some embodiments, the lock member 204 and the positioning structure 206 are situated in an indented canal in the block member 200 that is situated under the lock member 206 and the positioning structure 206 with the lock member 204 and the positioning structure 206 snap fit into place in the block member 200. In some embodiments, the block member 200 is a plastic piece that is snap fit onto the lock member 204. In some embodiments, the block member 200 is attached to the lock member 204 using a fastener, such as a screw. In some embodiments, the block member 202 is attached to the lock member 204 at the positioning structure 210 similar to the manner in which the block member 200 is snap fit onto the lock member 204 at the positioning structure 206.

The block member 200 includes a first chamber 220 that extends away from the body of the block member 200 and the block member 202 includes a second chamber 222 that extends away from the body of the block member 202. The openings of the chambers 220 and 222 are slanted to engage the lock actuator 114. Also, the length Lc1 of the first chamber 220 is shorter than the length Lc2 of the second chamber 222. These different lengths Lc1 and Lc2 of the chambers 220 and 222 are for engaging the lock actuator 114 and locking and unlocking different drawers and doors on different structures. In some embodiments, the notch 170 of the lock actuator 114 latches up with or engages the bottom side of a chamber, such as the bottom side 220*a* of chamber 220, to positively move the corresponding block member, such as block member 200.

FIGS. 16A-16F are diagrams illustrating front views of different examples of block members attached to lock members, according to some embodiments described in the disclosure.

Figure 16A:
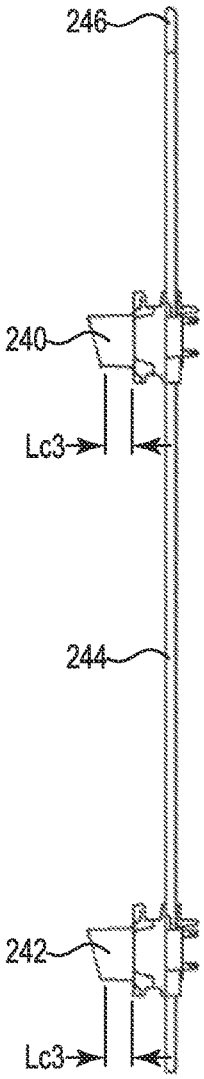
FIGS. 16A-16F are diagrams illustrating front views of different examples of block members attached to lock members, according to some embodiments.

FIG. 16A is a diagram illustrating two block members 240 and 242 having the same chamber length Lc3 and attached to a lock member 244 that includes a loop structure 246 at the top of the lock member 244.

Figure 16B:
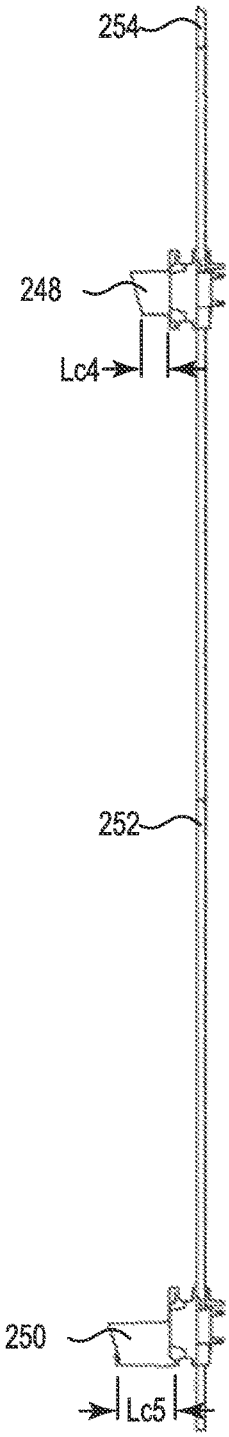

FIG. 16B is a diagram illustrating two block members 248 and 250 having different chamber lengths Lc4 and Lc5, respectively, and attached to a lock member 252 that includes a loop structure 254 at the top of the lock member 252. The lock member 252 is longer than the lock member 244 shown in FIG. 16A, and the block members 248 and 250 are spaced apart further than the block members 240 and 242.

Figure 16C:
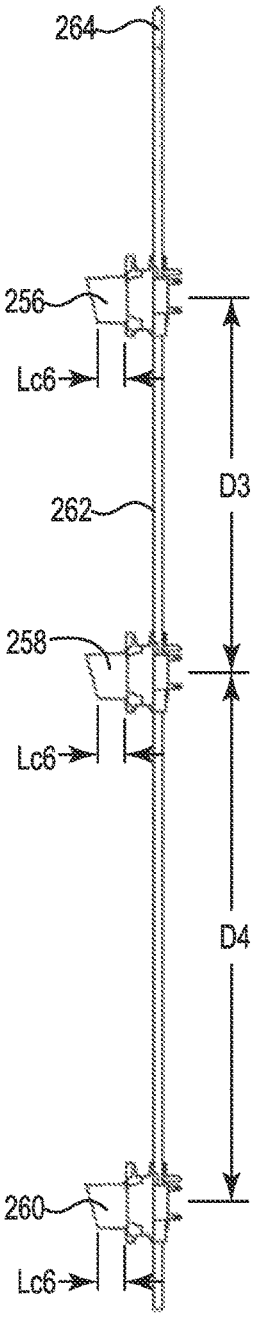

FIG. 16C is a diagram illustrating three block members 256, 258, and 260 having the same chamber length Lc6 and attached to a lock member 262 that includes a loop structure 264 at the top of the lock member 262. The lock member 262 is longer than the lock member 244 and shorter than the lock member 252. The block members 256, 258, and 260 are unevenly space apart on the lock member 262, such that the distance D3 is shorter than the distance D4. Also, the block members 256, 258, and 260 are spaced closer together than the block members 240 and 242 and closer together than the block member 248 and 250.

Figure 16D:
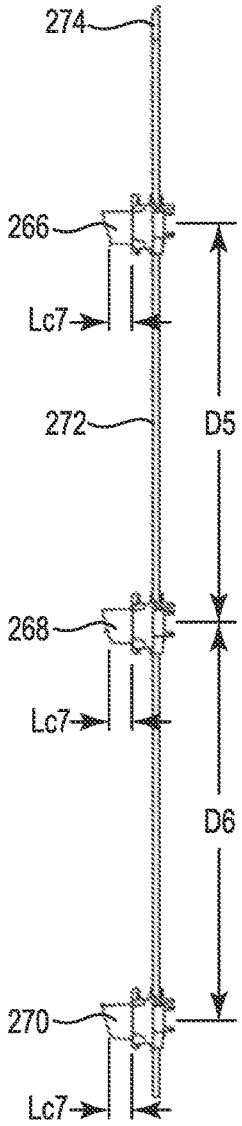

FIG. 16D is a diagram illustrating three block members 266, 268, and 270 having the same chamber length Lc7 and attached to a lock member 272 that includes a loop structure 274 at the top of the lock member 272. The block members 266, 268, and 270 are evenly space apart on the lock member 272, such that the distance D5 is equal to the distance D6.

Figure 16E:
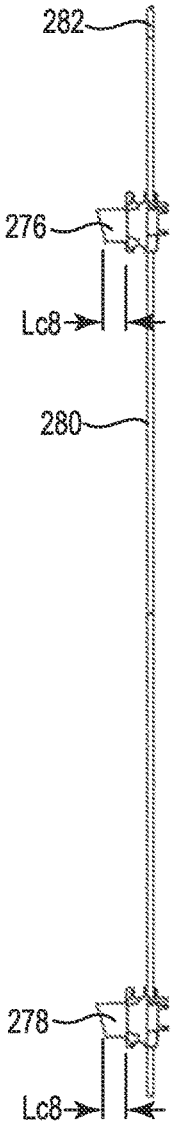

FIG. 16E is a diagram illustrating two block members 276 and 278 having the same chamber length Lc8 and attached to a lock member 280 that includes a loop structure 282 at the top of the lock member 280. The lock member 280 is the same length as the lock member 272, but the lock member 280 includes only the two block members 276 and 278 at positions on the lock member 280 that correspond to the positions of the two block members 266 and 270 on the lock member 272.

Figure 16F:
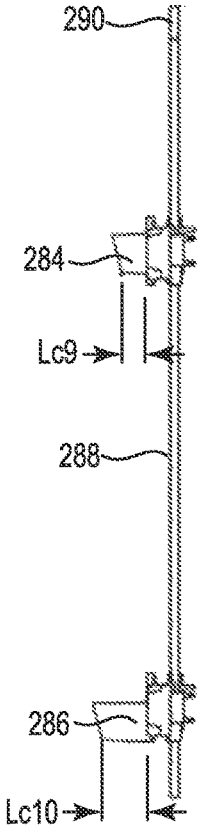

FIG. 16F is a diagram illustrating two block members 284 and 286 having different chamber lengths Lc9 and Lc10 and attached to a lock member 288 that includes a loop structure 290 at the top of the lock member 288. The lock member 288 is shorter than the lock member 280 and shorter than the lock member 272.

Figure 17:
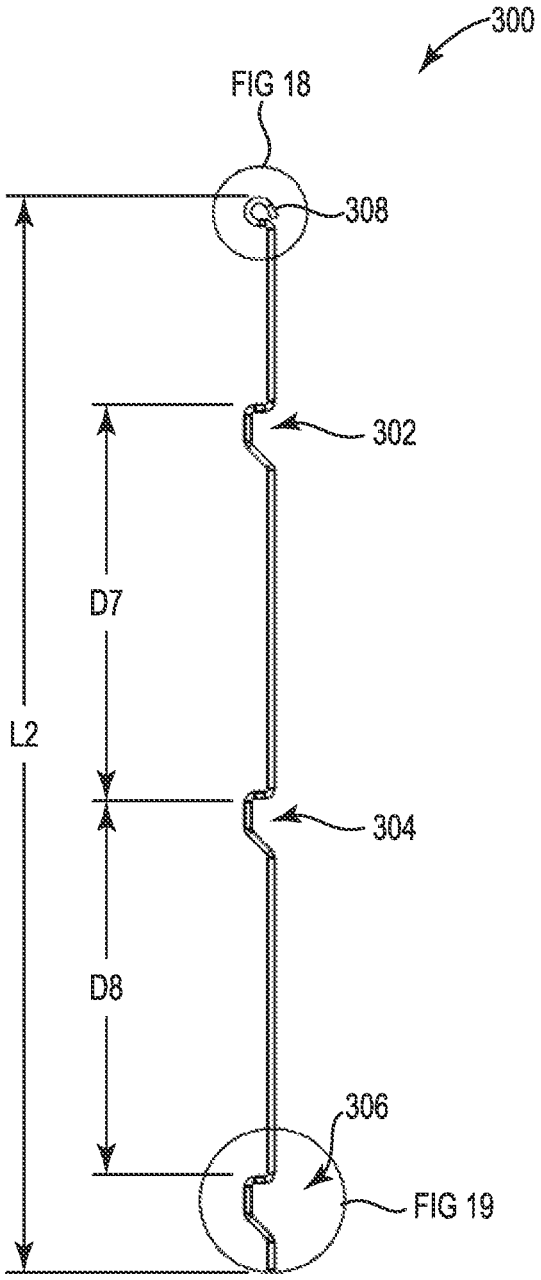
FIG. 17 is a diagram illustrating a perspective view of a lock member, according to some embodiments.
Figure 18:
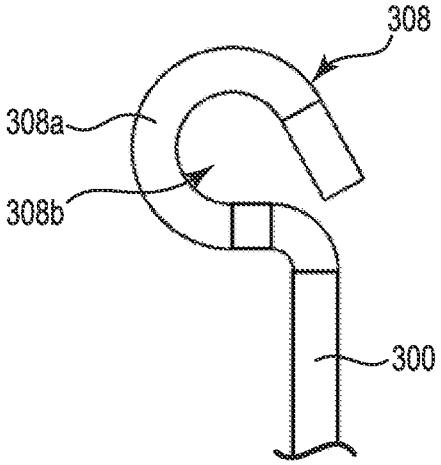
FIG. 18 is a diagram illustrating an enlarged view of a loop structure, according to some embodiments.
Figure 19:
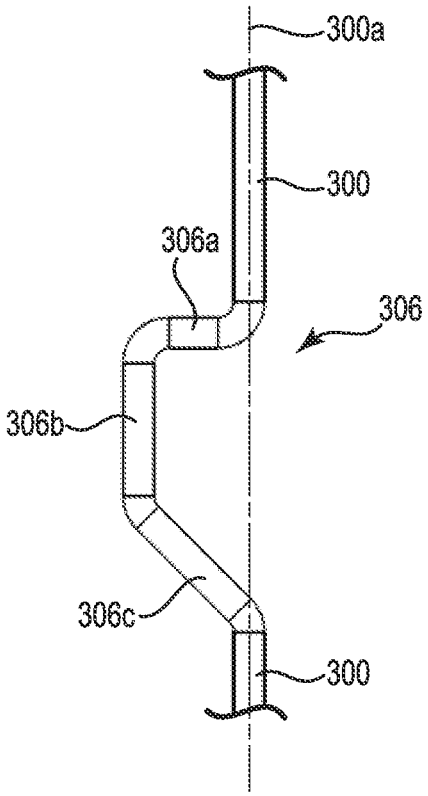
FIG. 19 is a diagram illustrating an enlarged view of a positioning structure, according to some embodiments.

FIGS. 17-19 are diagrams illustrating a lock member 300, according to some embodiments described in the disclosure. In some embodiments, the lock member 300 is used in the locking system 100 and cabinet 102 of FIGS. 1 and 2. In some embodiments, the lock member 300 is similar to lock member 108, shown in FIGS. 1 and 2.

FIG. 17 is a diagram illustrating a perspective view of the lock member 300, according to some embodiments. The lock member 300 includes positioning structures 302, 304, and 306 along the length L2 of the lock member 300, and a loop structure 308. The lock member 300 is a rigid wire that is bent to provide the positioning structures 302, 304, and 306 and the loop structure 308. In some embodiments, the lock member 300 includes more than three positioning structures. In some embodiments, the lock member 300 includes less than three positioning structures. In some embodiments, the lock member 300 includes any suitable number of positioning structures. In some embodiments, any suitable number of block members can be attached to the lock member 300.

The positioning structures 302, 304, and 306 are spaced apart distances D7 and D8 along the length L2 of the lock member 300. The positioning structure 302 is spaced apart from the positioning structure 304 the distance D7, and the positioning structure 304 is spaced apart from the positioning structure 306 the distance D8. In some embodiments, the positioning structures 302, 304, and 306 are evenly spaced apart along the length L2 of the lock member 300, such that distance D7 is equal to distance D8. In some embodiments, the positioning structures 302, 304, and 306 are unevenly spaced apart along the length L2 of the lock member 300, such that the distance D7 is not equal to the distance D8. In some embodiments, the lock member 300 includes any suitable number of positioning structures spaced apart by any suitable combination of distances.

FIG. 18 is a diagram illustrating an enlarged view of the loop structure 308, according to some embodiments. The loop structure 308 is located at the top of the lock member 300 and slides up and down with the lock member 300. The loop structure 308 includes an outer loop structure 308*a* and an inner loop aperture 308*b*. A rod member can be inserted through the inner loop aperture 308*b* to transfer movement of the lock member 300 to another lock member or another suitable member. In some embodiments, the loop structure 308 can be located at the bottom of the lock member 300.

FIG. 19 is a diagram illustrating an enlarged view of the positioning structure 306, according to some embodiments. The positioning structure 306 includes a horizontal portion 306*a* that is perpendicular to the longitudinal axis 300*a* of the lock member 300, a vertical portion 306*b* that is parallel to the longitudinal axis 300*a* of the lock member 300, and a transverse portion 306*c* that is angled with respect to the longitudinal axis 300*a* of the lock member 300. The horizontal portion 306*a* connects the lock member 300, above the horizontal portion 306*a* and along the longitudinal axis 300*a*, to the vertical portion 306*b*. The vertical portion 306*b* connects the horizontal portion 306*a* to the transvers portion 306*c*, and the transvers portion 306*c* connects the vertical portion 306*b* to the lock member 300, below the transvers portion 306*c* and along the longitudinal axis 300*a*. In some embodiments, each of the positioning structures 302 and 304 is similar to the positioning structure 306.

FIGS. 20-23 are diagrams illustrating a block member 320, according to some embodiments described in the disclosure. In some embodiments, the block member 320 is used in the locking system 100 and cabinet 102 of FIGS. 1 and 2. In some embodiments, the block member 320 is similar to the block member 110, shown in FIGS. 1 and 2. In some embodiments, the block member 320 is similar to at least one of the block members 200 and 202, shown in FIGS. 11-15.

Figure 20:
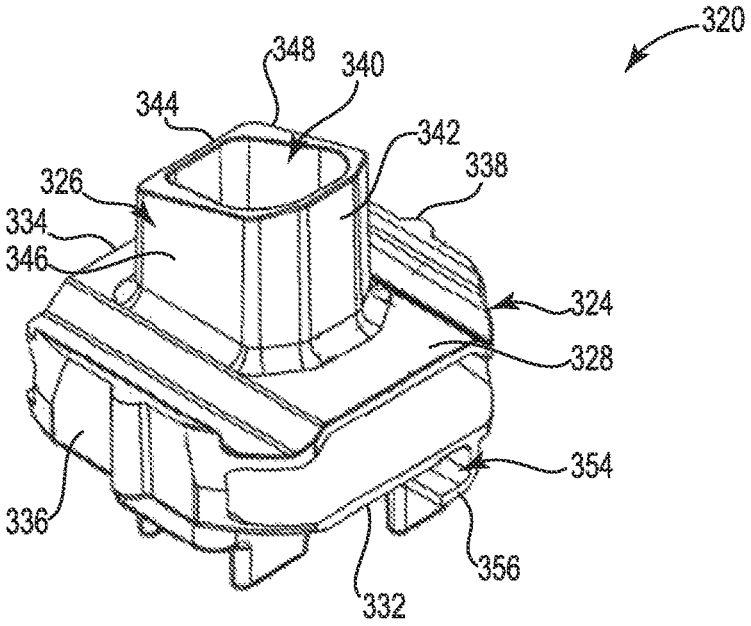
FIG. 20 is a diagram illustrating a perspective view of a block member, according to some embodiments.
Figure 21:
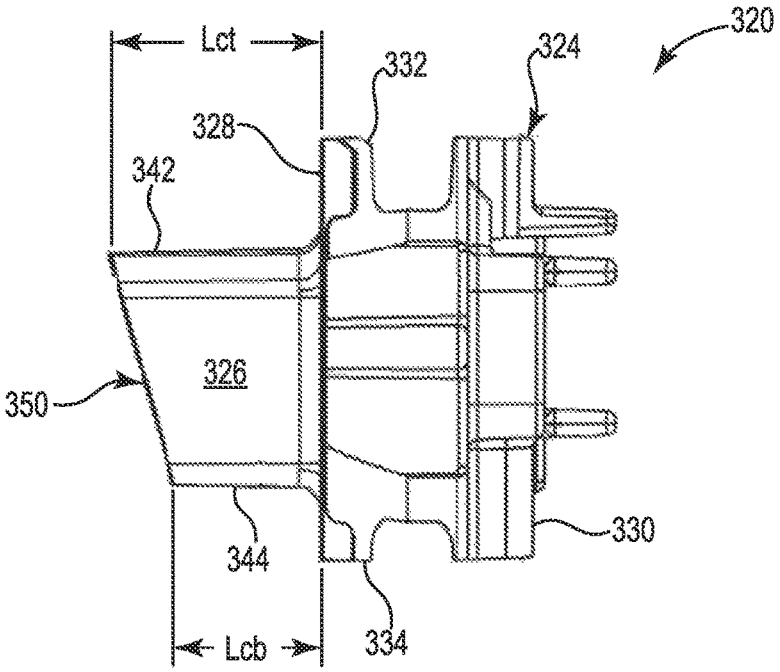
FIG. 21 is a diagram illustrating a front view, in relation to the cabinet of FIGS. 1 and 2, of the block member, according to some embodiments.
Figure 22:
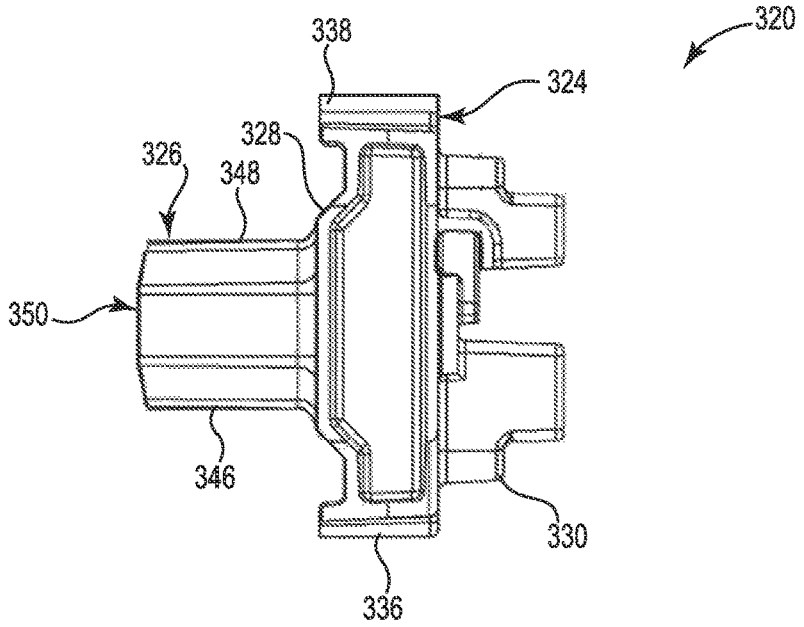
FIG. 22 is a diagram illustrating a top view of the block member, according to some embodiments.
Figure 23:
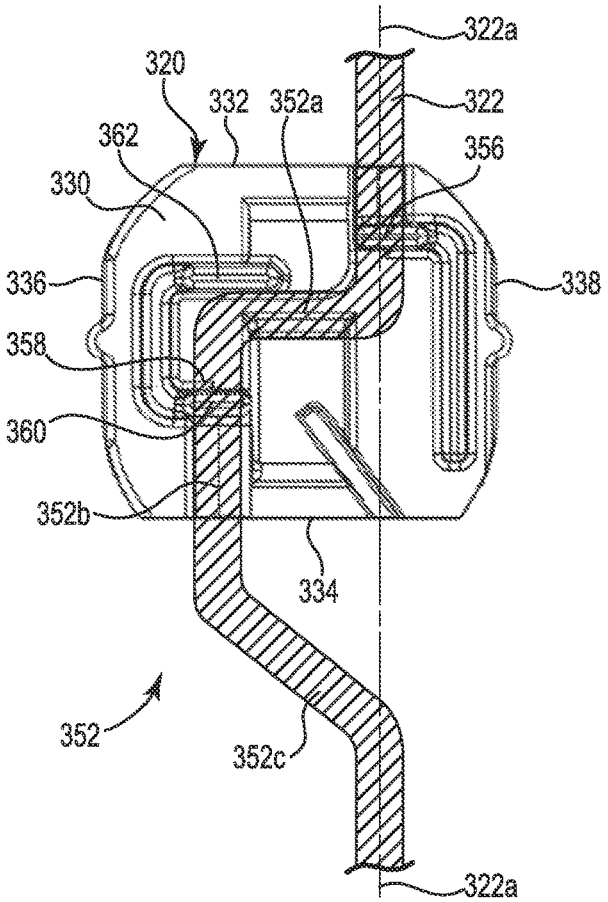
FIG. 23 is a diagram illustrating the block member attached to a lock member, according to some embodiments.

FIG. 20 is a diagram illustrating a perspective view of the block member 320, according to some embodiments. FIG. 21 is a diagram illustrating a front view, in relation to the cabinet 102 of FIGS. 1 and 2, of the block member 320, according to some embodiments. FIG. 22 is a diagram illustrating a top view of the block member 320, according to some embodiments. FIG. 23 is a diagram illustrating the block member 320 attached to a lock member 322, according to some embodiments.

The block member 320 includes a block body 324 and a chamber 326 that is attached to the block body 324. The block body 324 is cuboid shaped and includes a first chamber side 328, a second side 330 opposing the first chamber side 328, and four sides 332, 334, 336, and 338 forming a rectangle and situated between the first chamber side 328 and the second side 330.

The chamber 326 is attached to the first chamber side 328 and extends away from the first chamber side 328 and away from the block body 324. The chamber 326 includes a chamber aperture 340 defined by chamber walls 342, 344, 346, and 348 and having a chamber mouth 350. The chamber walls include a top wall 342, a bottom wall 344, and two side walls 346 and 348. The top wall 342 has a length Lct and the bottom wall 344 has a length Lcb that is less than the length Lct of the top wall 342. The top wall 342 extends further away from the block body 324 than the bottom wall 344 and the side walls 346 and 348 slant, at the chamber mouth 350, from the top wall 342 to the bottom wall 344. The chamber 326 is engaged by a lock actuator, such as the lock actuator 114 shown in FIGS. 1-6 and 8-10 to move the block member 320. In some embodiments, the notch 170 of the lock actuator 114 latches up with or engages the bottom wall 344 of the chamber 326 to positively raise or lift the block member 320. In some embodiments, the notch 170 of the lock actuator 114 latches up with or engages the bottom wall 344 of the chamber 326 to positively lower the block member 320. In some embodiments, one end of the cam portion 166 of the lock actuator 114 engages the top wall 342 of the chamber 326 to positively raise or lift the block member 320.

As shown in FIG. 23, the block member 320 is attached to the lock member 322. The lock member 322 includes a positioning structure 352 and the block member 320 is attached to the lock member 322 at the positioning structure 352. The attached block member 320 and the lock member 322 move up and down together to lock and unlock drawers or doors. In some embodiments, the lock member 322 is similar to the lock member 108 shown in FIGS. 1 and 2. In some embodiments, the lock member 322 is similar to the lock member 204 shown in FIGS. 11-15. In some embodiments, the lock member 322 is similar to the lock member 204 and the positioning structure 352 is similar to the positioning structure 206, shown in FIGS. 11-15.

The positioning structure 352 includes a horizontal portion 352*a* that is perpendicular to the longitudinal axis 322*a* of the lock member 322, a vertical portion 352*b* that is parallel to the longitudinal axis 322*a* of the lock member 322, and a transverse portion 352*c* that is angled with respect to the longitudinal axis 322*a* of the lock member 322. The horizontal portion 352*a* connects the lock member 322 along its longitudinal axis 322*a* above the horizontal portion 352*a* to the vertical portion 352*b*. The vertical portion 352*b* connects the horizontal portion 352*a* to the transvers portion 352*c*, and the transvers portion 352*c* connects the vertical portion 352*b* to the lock member 322 along its longitudinal axis 322*a* below the transverse portion 352*c*.

The block member 320 is snap fit onto the lock member 322 at the positioning structure 352 to prevent movement of the block member 320 on the lock member 322. The block member 320 includes a first slot or canal 354 that has a first overhanging or protruding structure 356 and a second slot or canal 358 that has a second overhanging or protruding structure 360. The block member 320 further includes a horizontal block portion 362.

The lock member 322, along its longitudinal axis 322*a* and above the horizontal portion 352*a*, is snap fit into the first slot 354 and the vertical portion 352*b* is snap fit into the second slot 358. The first and second overhanging or protruding structures 356 and 360 extend over the lock member 322 and the positioning structure 352, respectively, and snap fit the lock member 322 and the block member 320 together. Also, the horizontal block portion 362 touches the horizontal portion 352*a* to prevent downward vertical movement of the block member 320 on the lock member 322. In some embodiments, the lock member 322 and the positioning structure 352 are situated in an indented canal in the block member 320 that is under the lock member 322 and the positioning structure 352 with the lock member 322 and the positioning structure 352 snapped into place in the block member 320. In some embodiments, the block member 320 is a plastic piece that is snap fit onto the lock member 322. In some embodiments, the block member 320 is attached to the lock member 322 using a fastener, such as a screw. In some embodiments, the block member 320 is attached to the lock member 322 at the positioning structure 352 similar to the manner in which the block member 200 is snap fit onto the lock member 204 at the positioning structure 206.

Figure 24:
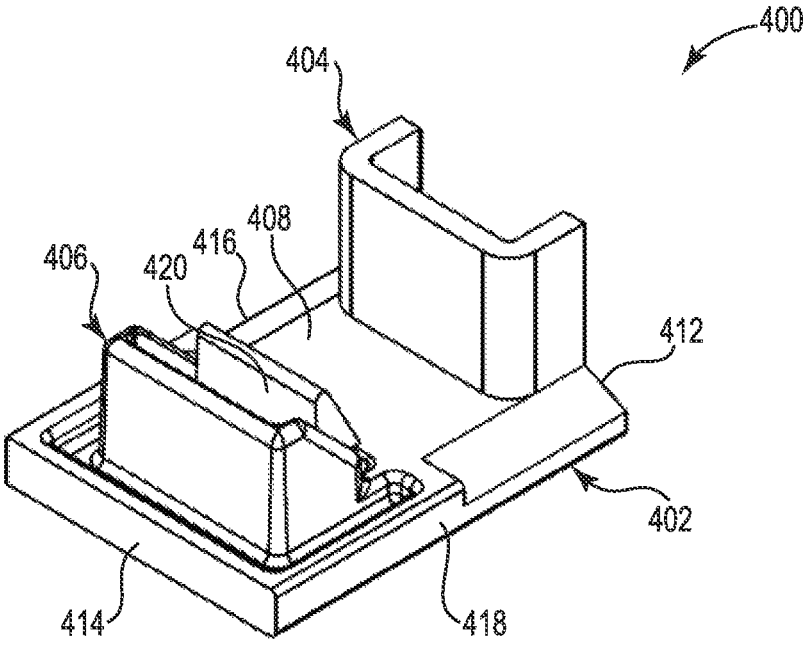
FIG. 24 is a diagram illustrating a perspective view of a lock stop member, according to some embodiments.
Figure 25:
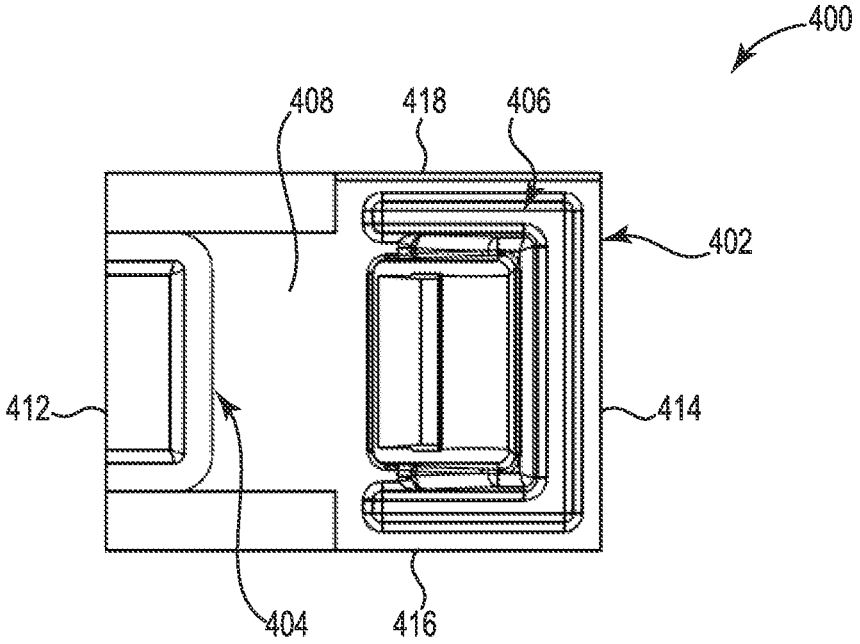
FIG. 25 is a diagram illustrating a top view of the lock stop member, according to some embodiments.
Figure 26:
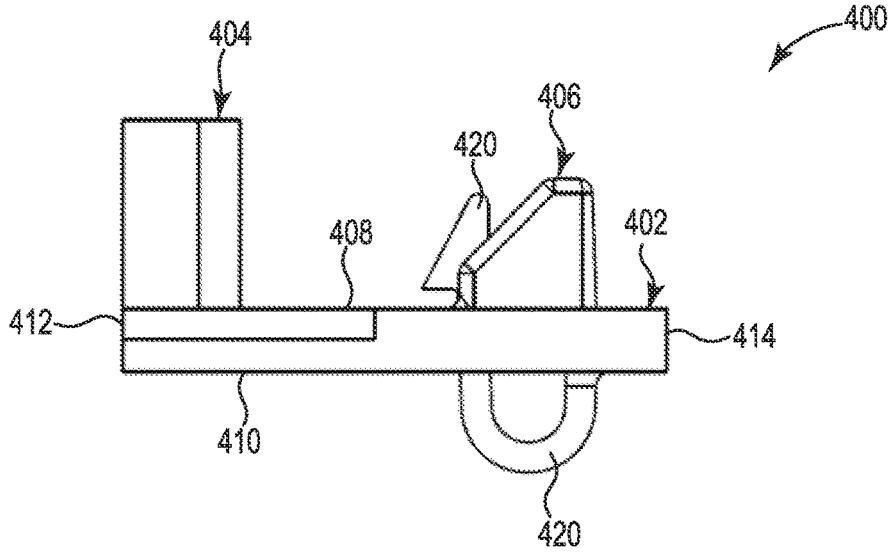
FIG. 26 is a diagram illustrating a side view of the lock stop member, according to some embodiments.

FIGS. 24-26 are diagrams illustrating a lock stop member 400, according to some embodiments described in the disclosure. In some embodiments, the lock stop member 400 is used in the locking system 100 and cabinet 102 of FIGS. 1 and 2. In some embodiments, the lock stop member 400 is similar to the lock stop member 122, shown in FIGS. 1 and 2.

FIG. 24 is a diagram illustrating a perspective view of the lock stop member 400, according to some embodiments. FIG. 25 is a diagram illustrating a top view of the lock stop member 400, according to some embodiments. FIG. 26 is a diagram illustrating a side view of the lock stop member 400, according to some embodiments.

The lock stop member 400 includes a stop body 402, a retaining wall member 404, and a latch member 406. The stop body 402 is cuboid shaped and includes a top side 408, a bottom side 410 opposing the top side 408, a first end 412, a second end 414 opposing the first end 412, and two opposing sides 416 and 418. The first end 412, the second end 414, and the two opposing sides 416 and 418 are situated between the top side 408 and the bottom side 410 to complete the cuboid shape.

The retaining wall member 404 and the latch member 406 are attached to the top side 408 of the stop body 402 and extend away from the top side 408 of the stop body 402. The retaining wall member 404 is attached to the top side 408 near the first end 412 and the latch member 406 is formed and attached to the top side 408 near the second end 414. A space, which is left between the retaining wall member 404 and the latch member 406, is used for positioning the lock stop member 400 on a structure to latch the lock stop member 400 to the structure, such as the cabinet 102. The latch member 406 includes a flexible, resilient latch mechanism 420 that flexes and snaps into place to latch onto the structure and hold the lock stop member 400 in place on the structure. The lock stop member 400 is attached to a structure, such as the cabinet 102, to stop a block member, such as block member 110, and align the block member with a lock actuator, such as the lock actuator 114, in the unlocked position.

Figure 27:
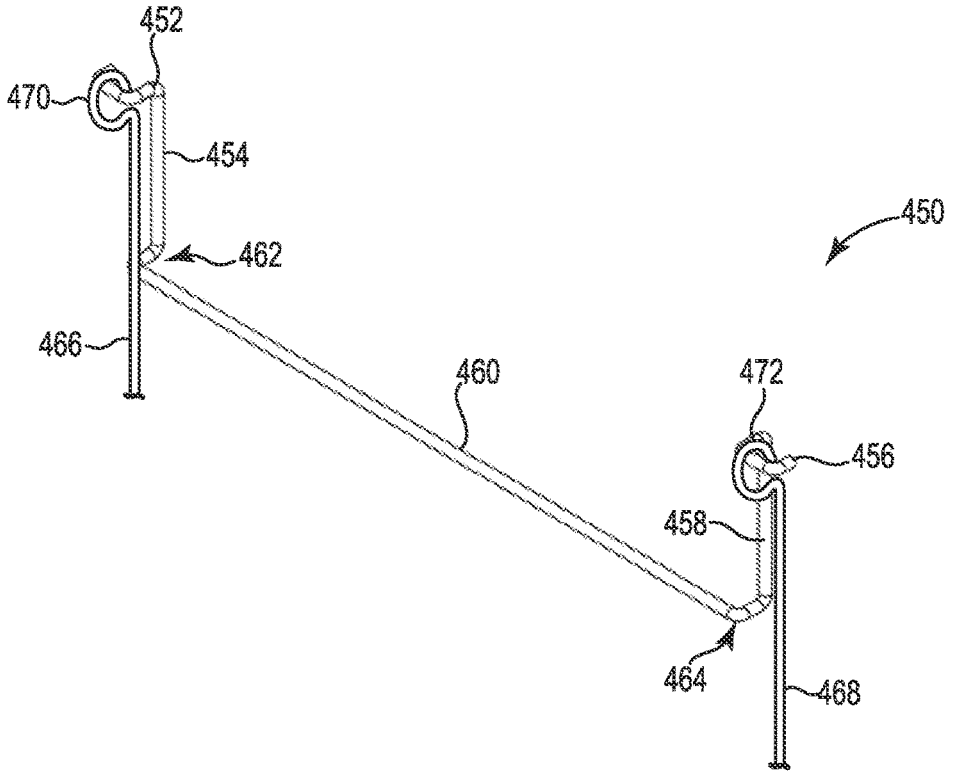
FIG. 27 is a diagram illustrating a lateral rod member, according to some embodiments described in the disclosure.

FIG. 27 is a diagram illustrating a lateral rod member 450, according to some embodiments described in the disclosure. The lateral rod member 450 includes a first hook member 452 connected to a first bar 454, a second hook member 456 connected to a second bar 458, and an offset lateral member 460 having a first end 462 connected to the first bar 454 and a second end 464 connected to the second bar 456. The lateral rod member 450 is attached to a structure or engaged with the structure to transfer motion from a first lock member 466 to a second lock member 468. In some embodiments, the lateral rod member 450 is slidably engaged with the structure to slide up and down as the first lock member 466 moves up and down and to transfer this movement to the second lock member 468. In some embodiments, the lateral rod member 450 is rotatably connected to the structure in the middle of the offset lateral member 460 to rotate as the first lock member 466 moves up and down and to transfer this movement to the second lock member 468. In some embodiments, the first lock member 466 is situated in the structure on one side of a drawer and the second lock member 468 is situated in the structure on the other side of the drawer to lock and unlock both sides of the drawer.

In operation, the first loop structure 470 of the first lock member 466 is hooked or looped onto the first hook member 452 and the second loop structure 472 of the second lock member 468 is hooked or looped onto the second hook member 456. As the first lock member 466 is moved up and down in a structure, as described in this disclosure, the lateral rod member 450 transfers the movement of the first lock member 466 to the second lock member 468 and moves the second lock member 468 up and down in the structure to lock and unlock a drawer or door.

Figure 28:
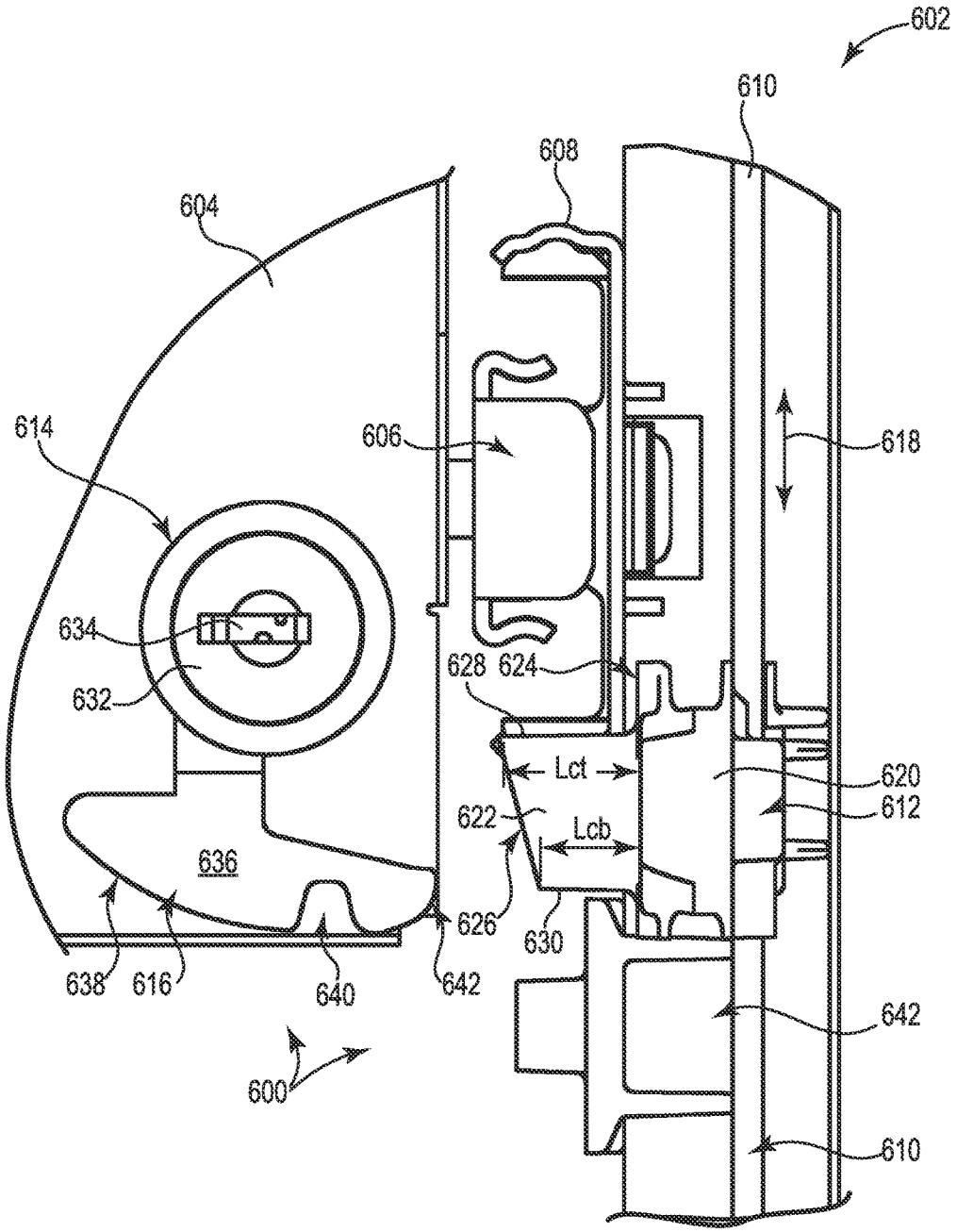
FIG. 28 is a diagram illustrating a locking system in the unlocked position, according to some embodiments.
Figure 29:
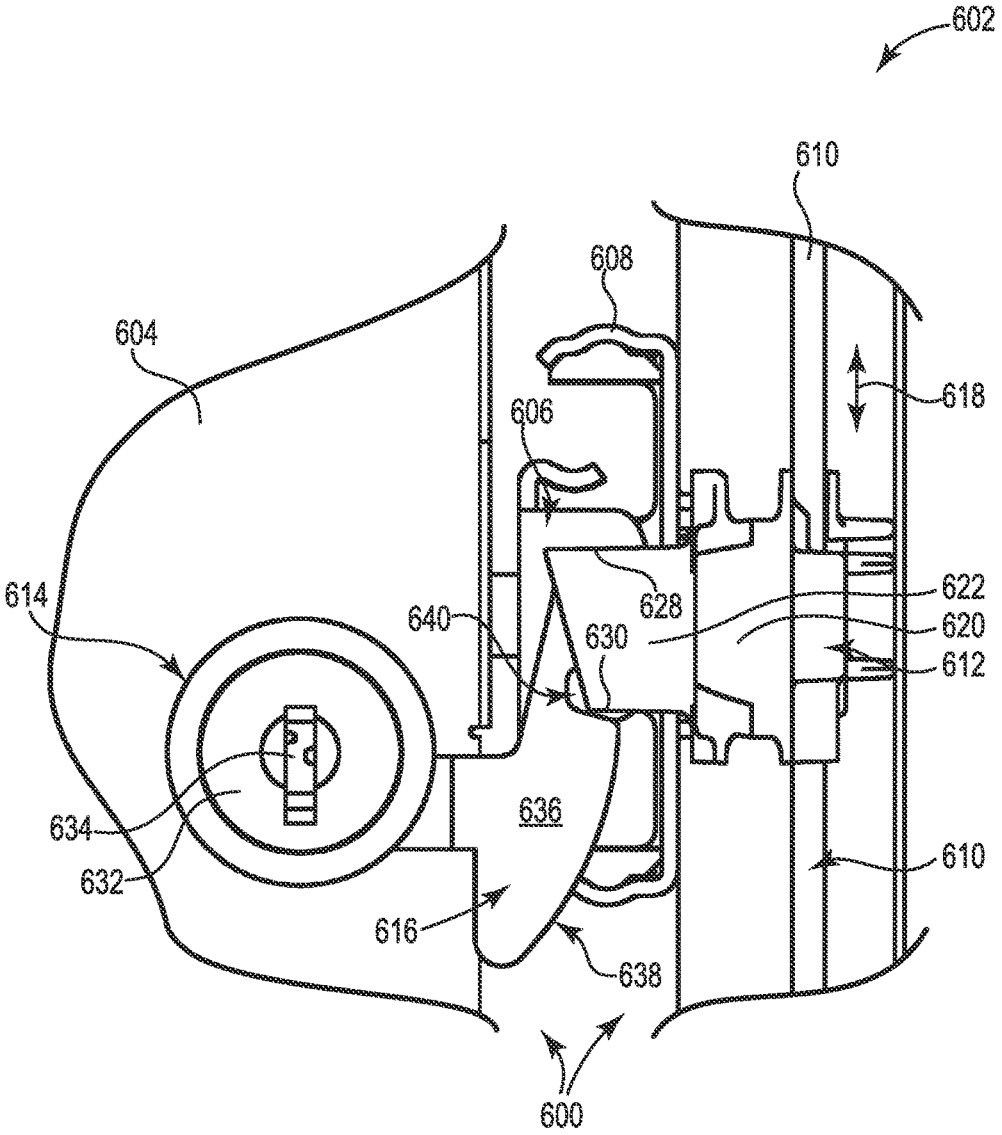
FIG. 29 is a diagram illustrating the locking system in the locked position, according to some embodiments.

FIGS. 28-31 are diagrams illustrating the operation of a locking system 600 in a cabinet 602, according to some embodiments described in the disclosure. The locking system 600 is situated in the cabinet 602 and configured to lock the cabinet 602 to prevent at least one drawer 604 from opening. The locking system 600 is also situated in the cabinet 602 and configured to unlock the cabinet 602 and allow the at least the drawer 604 to be opened. FIG. 28 is a diagram illustrating the locking system 600 in the unlocked position, according to some embodiments. FIG. 29 is a diagram illustrating the locking system 600 in the locked position, according to some embodiments.

The cabinet 602 includes the drawer 604 and a drawer slide 606 connected to the drawer 604. The drawer 604 and the drawer slide 606 ride on a corresponding drawer slide mechanism 608 attached to the cabinet 602 for smoothly opening and closing the drawer 604.

The locking system 600 includes a lock member 610, a block member 612, a locking core 614, and a lock actuator 616. The lock member 610 is attached to the cabinet 602, such that the lock member 610 can slide up and down in the cabinet 602, as indicated by arrow 618. The lock member 610 includes one or more positioning structures along the length of the lock member 610, as described above in reference to the lock members. The lock member 610 is a metal wire lock member. In some embodiments, the lock member 610 includes a rigid metal wire that is bent to provide the positioning structures. In some embodiments, the lock member 610 is made from a different material, such as plastic. In some embodiments, the lock member 610 is similar to the lock member 108, shown in FIGS. 1 and 2. In some embodiments, the lock member 610 is similar to the lock member 204, shown in FIGS. 11-15. In some embodiments, the lock member 610 is similar to one or more of the lock members shown in FIGS. 16A-16F and 17-19.

The block member 612 is snap fit onto the lock member 610 at a positioning structure, as described above, to prevent the block member 612 from moving on the lock member 610. The block member 612 and the lock member 610 slide up and down together in the cabinet 602.

The block member 612 includes a block body 620 and a block chamber 622 that is attached to the block body 620. The block body 620 is cuboid shaped and includes a first chamber side 624 facing away from the lock member 610. The chamber 622 is attached to the first chamber side 624 and extends away from the first chamber side 624 and the block body 620. The chamber 622 includes a chamber mouth 626 that opens into a chamber aperture that is defined by four chamber walls, as describe above in relation to the block member 320. The chamber 622 includes a top wall 628 and a bottom wall 630 that has a length Lcb that is less than the length Lct of the top wall 628. The chamber mouth 626 slants from the top wall 628 to the bottom wall 630. In some embodiments, the block member 612 is similar to the block member 320 of FIGS. 20-23.

The locking core 614 is a locking mechanism or lock that rotates between an unlocked position, shown in FIG. 28, and a locked position, shown in FIG. 29. The lock actuator 616 is secured to the locking core 614 and rotates with the locking core 614 between the locked position and the unlocked position. The locking core 614 includes a front face 632 and a key hole 634 in the front face 632. The locking core 614 is secured to the drawer 604 with the front face 632 and the key hole 634 visible and accessible to a user. Also, the lock actuator 616 is aligned with the block member 612 to engage the chamber 622. The locking core 614 is rotated by inserting a key in the key hole 634 and rotating the key. In some embodiments, the lock actuator 616 is keyed to the locking core 614 to rotate with the locking core 614. In some embodiments, the locking core 614 is similar to the locking core 112, shown in FIGS. 1-7.

The lock actuator 616 is attached to the locking core 614 and includes a cam portion 636. The cam portion 636 is curved to form a cam shaped side 638 and the cam portion 636 includes a notch 640 in the cam shaped side 638. The cam portion 636, including the notch 640, engages the block member 612 to lock and unlock the drawer 604. In some embodiments, the lock actuator 616 is similar to the lock actuator 114, shown in FIGS. 1-6 and 8-10.

The locking system 600 also includes a lock stop member 642 that is attached to the cabinet 602. In the unlocked position, shown in FIG. 28, the lock stop member 642 touches and abuts the block member 612 to prevent the block member 612 and the lock member 610 from sliding out of alignment with the lock actuator 616. The lock stop member maintains alignment of or aligns the block member 612 with the lock actuator 616. In some embodiments, the lock stop member 642 is similar to the lock stop member 122 of FIGS. 1 and 2. In some embodiments, the lock stop member 642 is similar to the lock stop member 400 of FIGS. 24-26.

In operation, a key is inserted in the key hole 634 of the locking core 614 and rotated to rotate the locking core 614 between the unlocked position and the locked position. This rotates the locking core 614 and the lock actuator 616, which engages the block member 612 to raise and lower the block member 612 and the lock member 610 in the cabinet 604. In some embodiments, the notch 640 in the cam portion 636 of the lock actuator 616 engages the bottom wall 630 of the block member 612 to positively raise and lower the block member 612. In some embodiments, a top end 642 of the lock actuator 616 at least lightly engages the top wall 628 of the block member 612 to raise the block member 612.

In the unlocked position, shown in FIG. 28, the locking core 614 has been turned to the unlocked position. While turning the locking core 614 from the locked position shown in FIG. 29 to the unlocked position shown in FIG. 28, the notch 640 and the cam portion 636 of the lock actuator 616 push on the bottom wall 630 of the block member 612 to positively lower the block member 612 from in front of the drawer slide 606. Upon further turning of the locking core 614, the notch 640 and the cam portion 636 disengage from the bottom wall 630 and turn out of the way of the block member 612 and the cabinet 602, which allows the drawer 604 to be opened and closed.

In the locked position, shown in FIG. 29, the locking core 614 has been turned to the locked position. While turning the locking core 614 from the unlocked position shown in FIG. 28 to the locked position shown in FIG. 29, the notch 640 and the cam portion 636 of the lock actuator 616 push up on the bottom wall 630 of the block member 612 to positively raise the block member 612 from below the drawer slide 606 to in front of the drawer slide 606. This locks the drawer 604 and prevents the drawer 604 from being opened.

If other block members are attached to the lock member 610, each of the attached block members moves with the lock member610 to unlock and lock a different drawer or door similar to the operation of block member 612.

Figure 30:
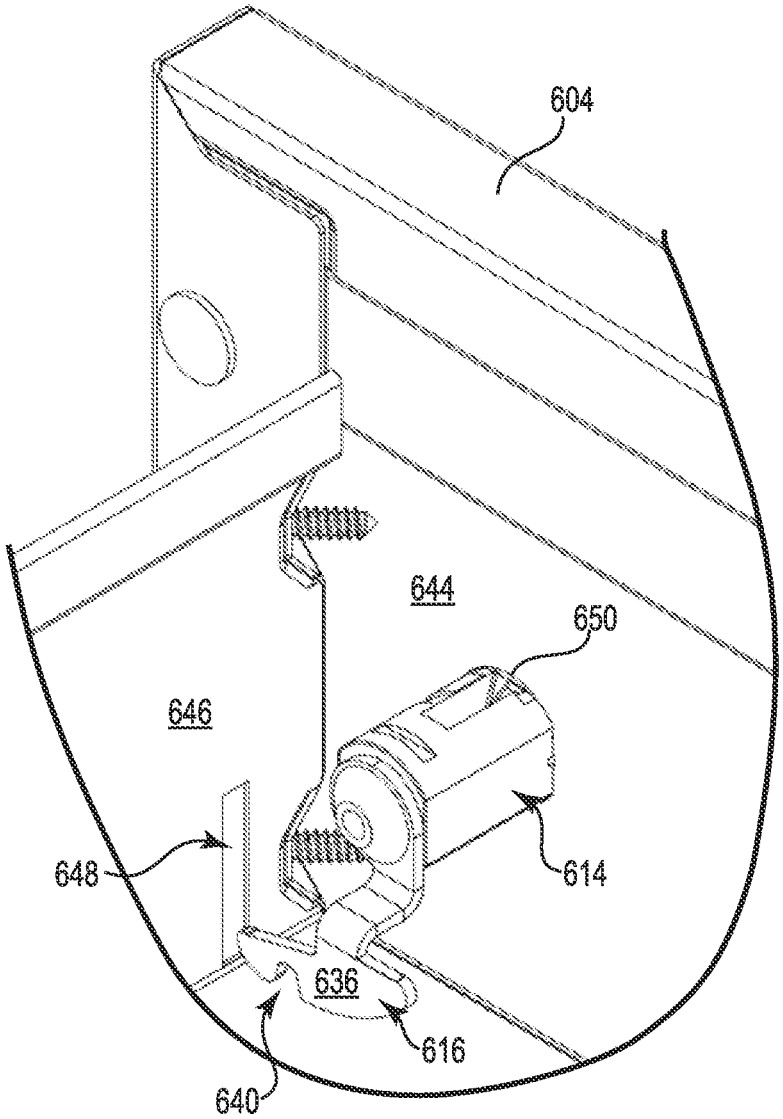
FIG. 30 is a diagram illustrating the locking core and the lock actuator in the unlocked position and secured to the drawer, according to some embodiments.
Figure 31:
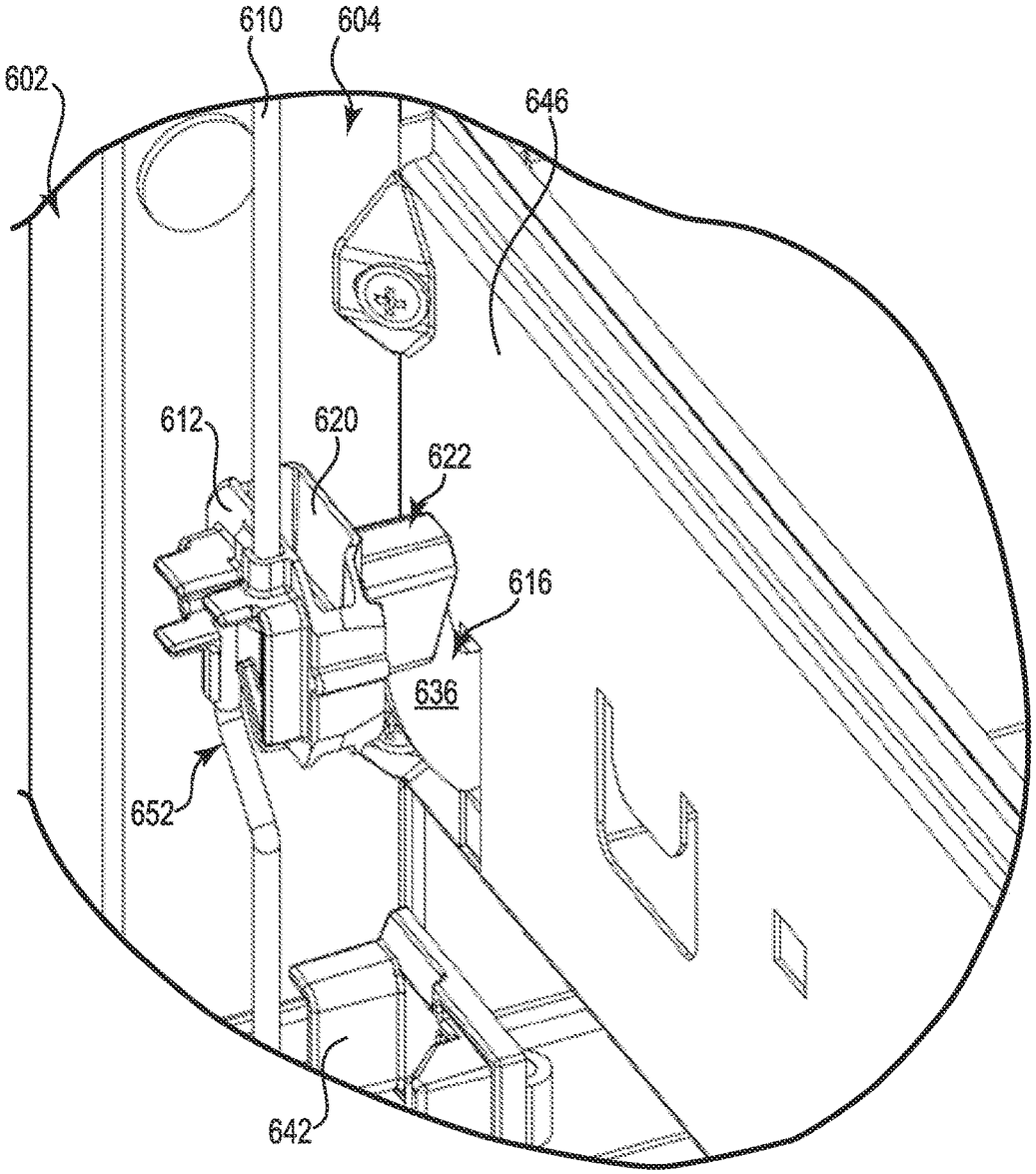
FIG. 31 is a diagram illustrating the block member engaged by the lock actuator on the other side of the drawer side wall and in the locked position, according to some embodiments.

FIGS. 30 and 31 are diagrams illustrating components of the locking system 600 attached to the cabinet 602 and the drawer 604.

FIG. 30 is a diagram illustrating the locking core 614 and the lock actuator 616 in the unlocked position and secured to the drawer 604, according to some embodiments. The drawer 604 includes a drawer front 644 and a drawer side wall 646 that has a slot 648 cut into the drawer side wall 646. The locking core 614 is inserted through a hole in the drawer front 644 and attached to the drawer front 644, such as with one or more locking tabs 650. The lock actuator 616 is aligned with the slot 648, such that when the locking core 614 and the lock actuator 616 are turned from the unlocked position, the cam portion 636 and the notch 640 of the lock actuator 616 move through the slot 648 to touch and engage the block member 612 on the other side of the drawer side wall 646.

FIG. 31 is a diagram illustrating the block member 612 engaged by the lock actuator 616 on the other side of the drawer side wall 646 and in the locked position, according to some embodiments. The block member 612, including the block body 620 and the chamber 622, is mounted on the lock member 610 at the position structure 652. The lock member 610 and the block member 612 are attached to the cabinet 602 to move up and down in the cabinet 602. As the locking core 614 is rotated from the unlocked position, shown in FIG. 30, to the locked position, shown in FIG. 31, the cam portion 636 and the notch 640 of the lock actuator 616 move through the slot 648 to touch and engage the bottom wall 630 of the chamber 622. Further, turning the locking core 614 raises the block member 612 to in front of the drawer slide 606 to lock the drawer 604 shut.

Figure 32:
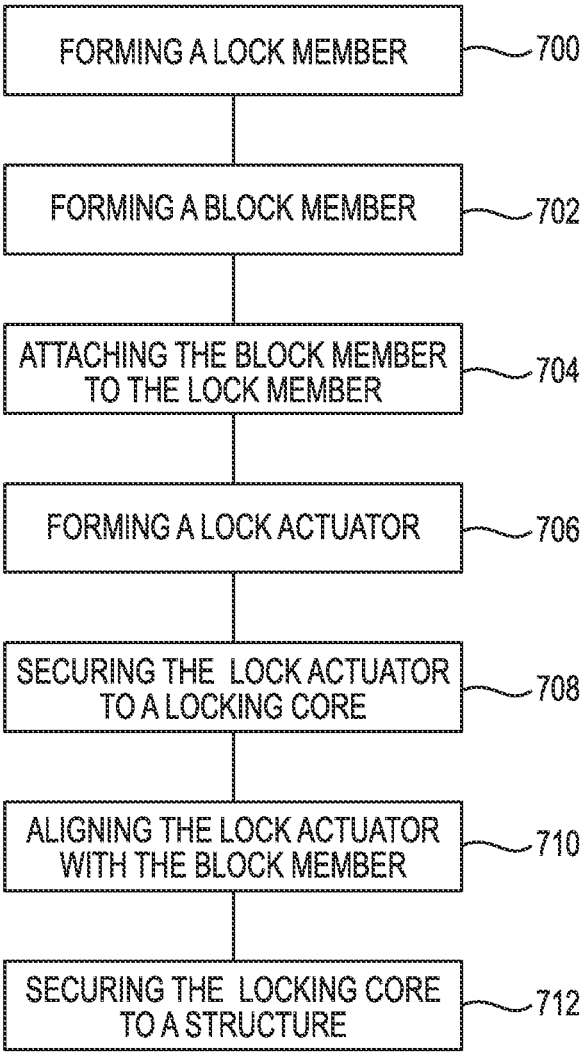
FIG. 32 is a flow chart diagram illustrating a method of making a locking system, according to some embodiments.

FIG. 32 is a flow chart diagram illustrating a method of making a locking system, according to some embodiments described in the disclosure. In some embodiments, the locking system is similar to the locking system 100 shown in FIGS. 1 and 2. In some embodiments, the locking system is similar to the locking system 600 shown in FIGS. 28-31.

At 700, the method includes the step of forming a lock member that includes at least one positioning structure. In some embodiments, the lock member is formed to include a positioning structure that includes a horizontal portion, a vertical portion, and a transverse portion. In some embodiments, a wire lock member is bent to include a first perpendicular bend in the wire to form the horizontal portion and a second perpendicular bend in the wire to form the vertical portion.

At 702, the method includes the step of forming a block member, and at 704, the method includes the step of attaching the block member to the lock member at the positioning structure. In some embodiments, the block member is formed to include a slot or a canal that receives the first and second perpendicular bends, the horizontal portion, and the vertical portion to secure the lock member in the block member and prevent movement of the block member on the lock member. In some embodiments, the block member is formed to include at least one resilient protrusion overhanging an indentation or a canal in the block member to receive the lock member and hold the lock member in the block member.

At 706, the method includes the step of forming a lock actuator, and at 708, the method includes the step of securing the lock actuator to a locking core that rotates between a locked position and an unlocked position. In some embodiments, the method includes the step of forming a notch in the lock actuator.

At 710, the method includes the step of aligning the lock actuator with the block member, and at 712, the method includes the step of securing the locking core to a structure such that the lock actuator moves the block member between a first position that corresponds to the locked position and a second position that corresponds to the unlocked position. In some embodiments, the method includes the step of forming a notch in the lock actuator and aligning the notch in the lock actuator with the block member to move the block member between the first position and the second position.

Various modifications and additions can be made to the embodiments discussed without departing from the scope of the present invention. For example, while the embodiments described above refer to particular features, the scope of this invention also includes embodiments having different combinations of features and embodiments that do not include all of the above described features.

We claim:

1. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a second block attached to the first wire at a second positioning structure of the at least one positioning structure to prevent movement of the second block on the first wire, wherein the second block moves between a third position that corresponds to the locked position and a fourth position that corresponds to the unlocked position as the cam moves the first block;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core.

2. The locking system of claim 1, wherein the cam includes a notch that engages the first block to move the first block between the first position and the second position.

3. The locking system of claim 1, wherein the first positioning structure includes a perpendicular bend in the first wire and the first block includes an indented portion that receives the perpendicular bend to prevent movement of the first block on the first wire.

4. The locking system of claim 1, wherein the cam is a rigid cam member.

5. The locking system of claim 1, wherein the first wire includes a loop to transfer movement of the first wire.

6. The locking system of claim 1, wherein the locking core is a cylindrical locking core defining a longitudinal axis and the cam is secured to the locking core such that the cam rotates in a plane that is perpendicular to the longitudinal axis of the locking core.

7. The locking system of claim 1, comprising a lock stop attached to a cabinet to align the first block with the cam.

8. The locking system of claim 1, wherein the first block includes a chamber to receive the cam.

9. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core;

wherein the first block includes at least one resilient protrusion overhanging an indentation in the first block to receive the first wire and hold the first wire in the first block.

10. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core;

wherein the first wire includes a loop to transfer movement of the first wire and comprising a rod engaged with the loop of the first wire and engaged with a loop of a second wire to move the second wire as the cam moves the first wire.

11. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core;

wherein multiple positioning structures of the at least one positioning structure are evenly spaced apart along the first wire.

12. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core;

wherein multiple positioning structures of the at least one positioning structure are unevenly spaced apart along the first wire.

13. A locking system comprising:

a first wire having at least one positioning structure formed by one or more bends in the wire, the at least one positioning structure includes a first positioning structure and a second positioning structure, the wire having a longitudinal axis defining longitudinal direction;

a first block attached to the first wire at the first positioning structure, the first positioning structure configured to prevent movement of the first block on the first wire;

a locking core configured to rotate between a locked position and an unlocked position; and a cam secured to the locking core, the cam being rotatable by the locking core to engage and translate the first block to transition rotational movement of the cam to longitudinal movement of the first block in the longitudinal direction such that the first wire is moved longitudinally in the longitudinal direction by the first block along the longitudinal axis of the first wire between a first position of the first block that corresponds to the locked position of the locking core and a second position of the first block that corresponds to the unlocked position of the locking core;

wherein the first block is configured to interfere with the travel of a drawer slide of a drawer in the first position by being in front of the drawer slide and to allow the drawer to be opened and closed in the second position by being moved from in front of the drawer slide.

* * * * *